United States Patent [19]

Booth

[11] Patent Number: 4,584,821

[45] Date of Patent: Apr. 29, 1986

[54] AUTOMATIC CARTONING MACHINE AND METHOD FOR PACKAGING ARTICLES SUCH AS FRUIT

[75] Inventor: John L. Booth, Vero Beach, Fla.

[73] Assignee: Booth Manufacturing Co., Ft. Pierce, Fla.

[21] Appl. No.: 406,293

[22] Filed: Aug. 9, 1982

[51] Int. Cl.[4] ..... B65B 35/30

[52] U.S. Cl. ..... 53/448; 53/157; 53/238; 53/247; 53/466; 53/474; 53/539; 414/59

[58] Field of Search ..... 53/157, 207, 218, 228, 53/238, 247, 248, 448, 466, 474, 475, 534, 539, 543; 198/434; 414/59

[56] References Cited

U.S. PATENT DOCUMENTS

| | | | |
|---|---|---|---|
| 2,753,673 | 7/1956 | Olive | 53/247 |
| 3,338,009 | 8/1967 | Stevens | 53/247 X |
| 3,431,702 | 3/1969 | Spaulding | 53/247 X |
| 3,683,582 | 8/1972 | Seguin | 53/448 |
| 3,842,570 | 10/1974 | Monaghan | 53/207 X |
| 3,986,319 | 10/1976 | Puskarz et al. | 53/207 X |
| 4,149,355 | 4/1979 | Clegg | 53/448 |
| 4,149,452 | 4/1979 | Talarico | 53/207 X |
| 4,233,802 | 11/1980 | Booth et al. | 53/475 |
| 4,258,532 | 3/1981 | Dilot | 53/207 X |

*Primary Examiner*—John Sipos

*Assistant Examiner*—Steven P. Weihrouch

*Attorney, Agent, or Firm*—Carroll F. Palmer

[57] ABSTRACT

A machine and method for automatically cartoning fruit in the cells of a protective honeycomb, in which the method includes the steps of positioning a foldable carton blank at a first station, disposing an expanded honeycomb defining a plurality of open cells over the blank, depositing articles such as fruit in the cells to form a fruit-filled honeycomb on the blank, and forming the carton blank into a base portion and side and end portions closely embracing the periphery of the fruit filled honeycomb, thereby to form a self-supporting fruit containing carbon. The machine comprises means for feeding a carton blank to and receiving the carton blank at a loading station, means for receiving and for gripping and expanding a honeycomb blank into an expanded honeycomb having a plurality of open cells at the loading station directly above the carton blank, and conveyor and chute means for conveying and depositing fruit downwardly into the cells, thereby to provide a fruit-filled honeycomb supported on the carbon blank. The machine further comprises means for forming the carton blank into a base portion which supports the fruit-filled honeycomb and into side portions and end portions which closely embrace the sides and ends of the article-filled honeycomb.

5 Claims, 29 Drawing Figures

FIG. 1
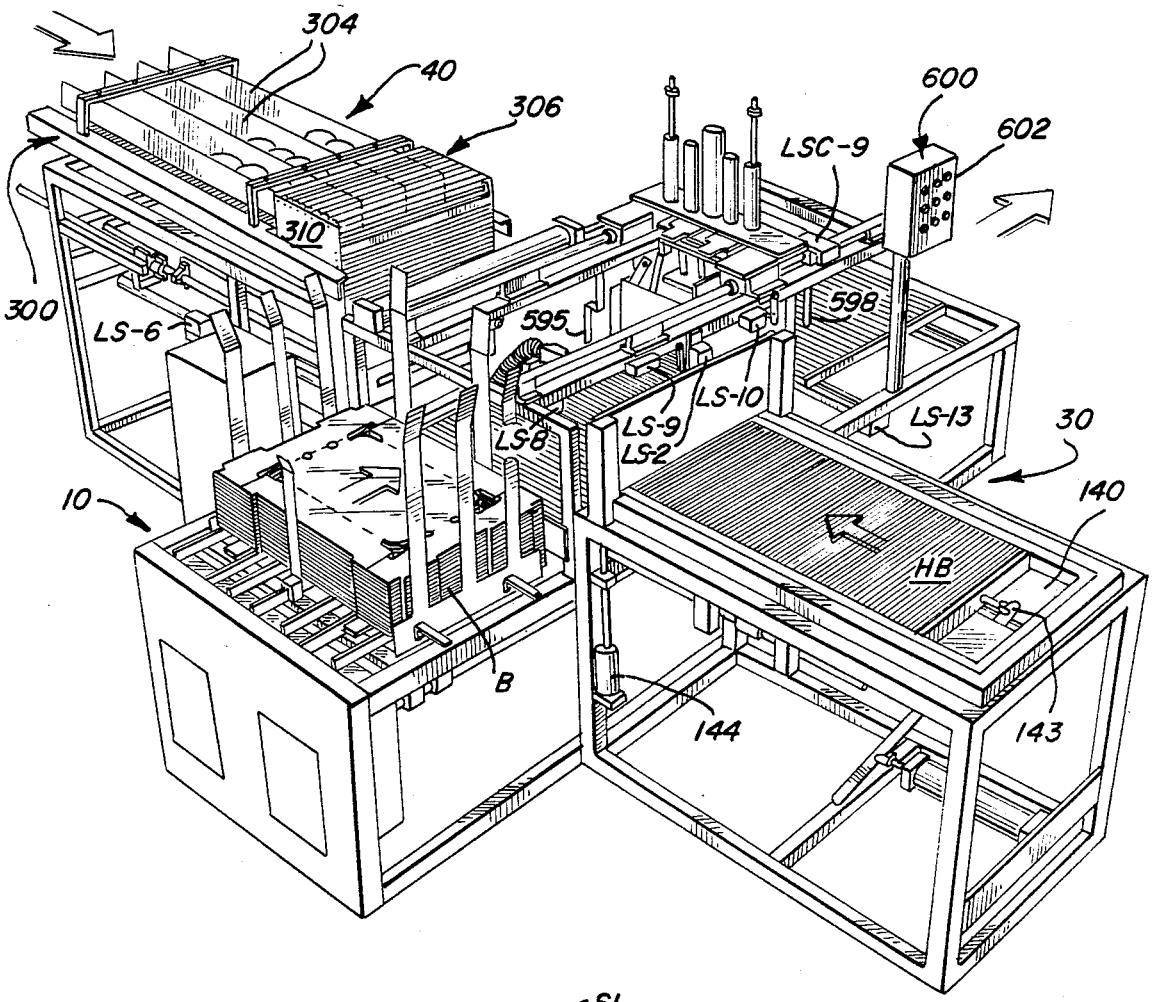
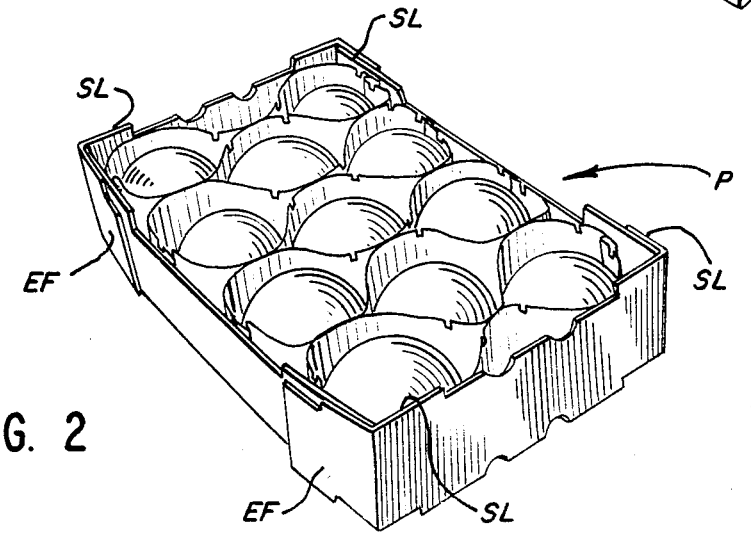
FIG. 2

FIG. 9
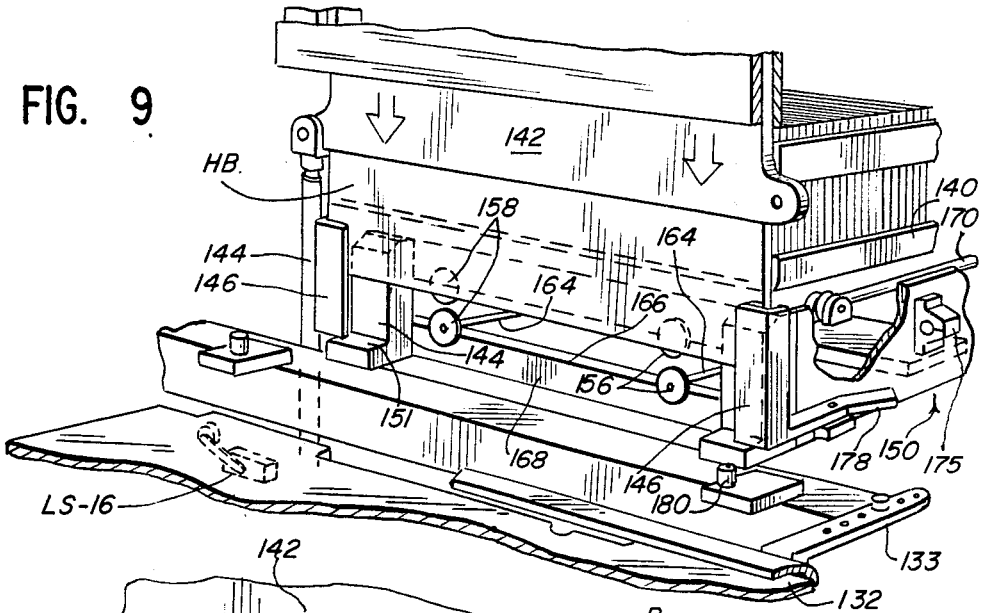
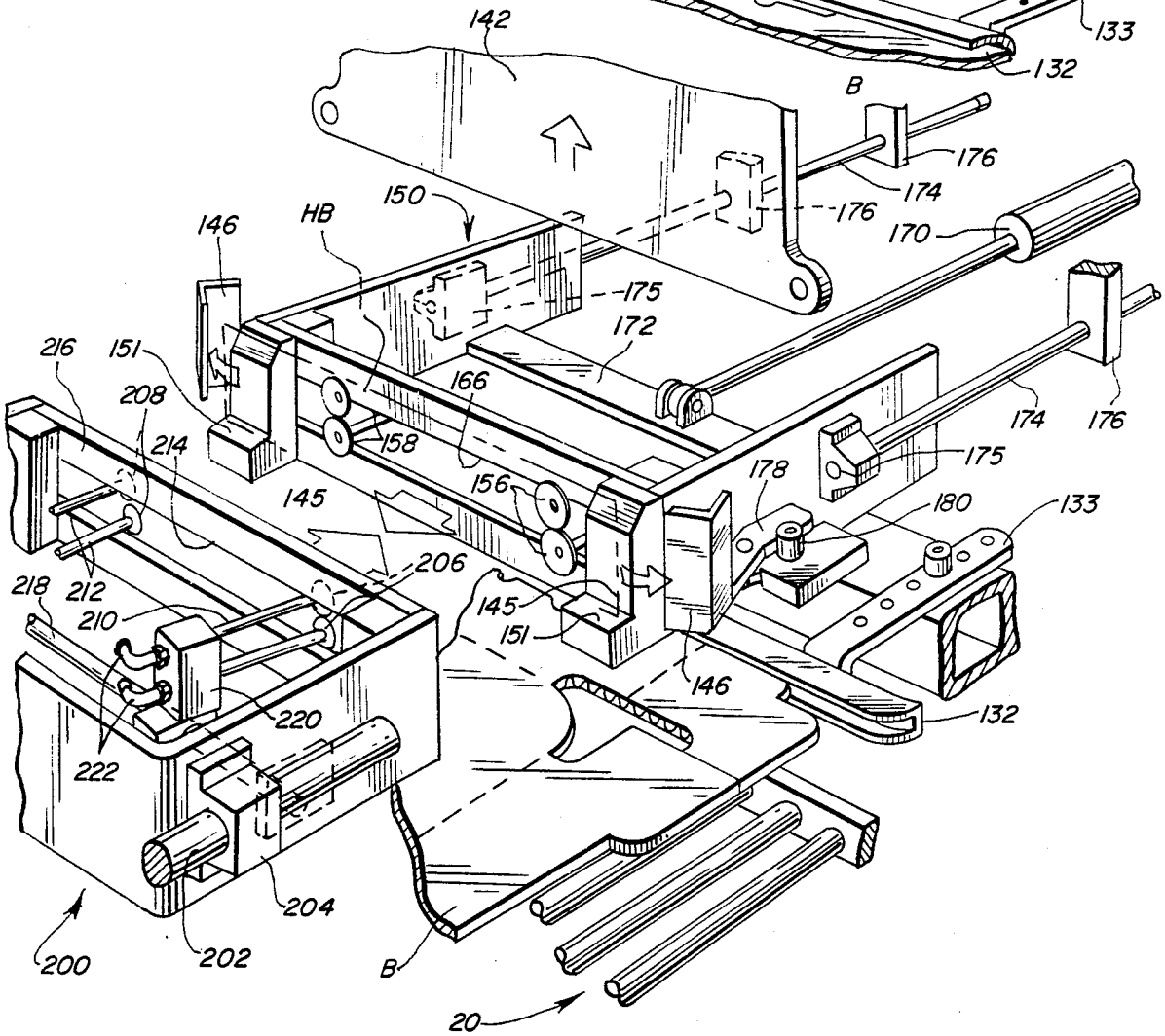
FIG. 10

FIG. 12
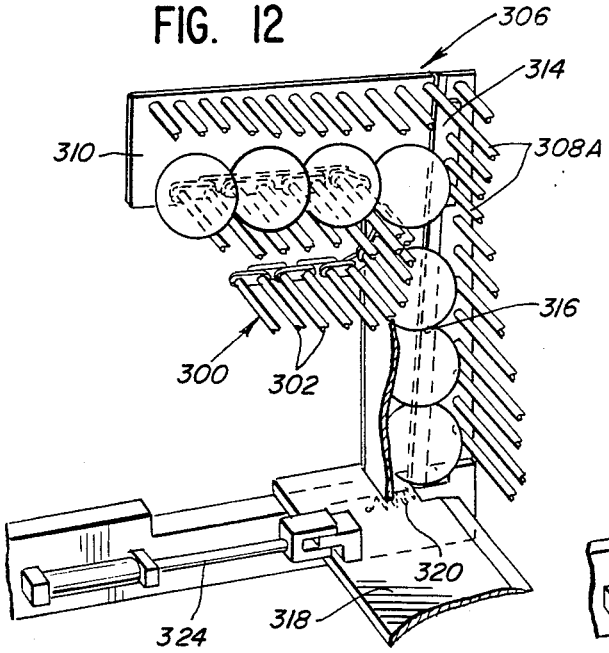
FIG. 13
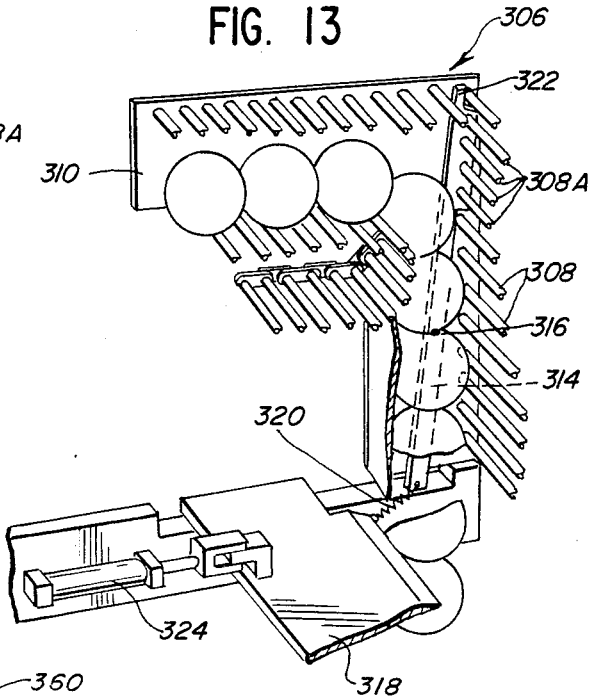
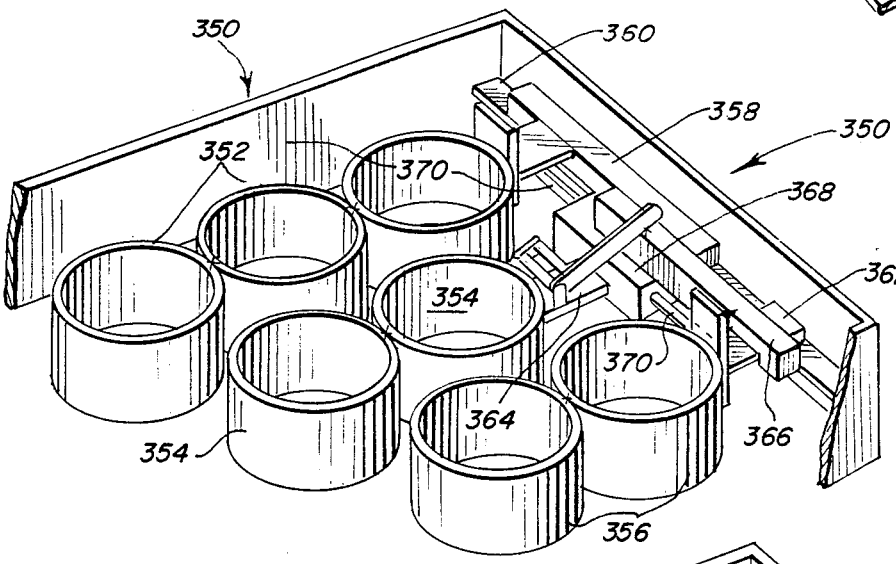
FIG. 14
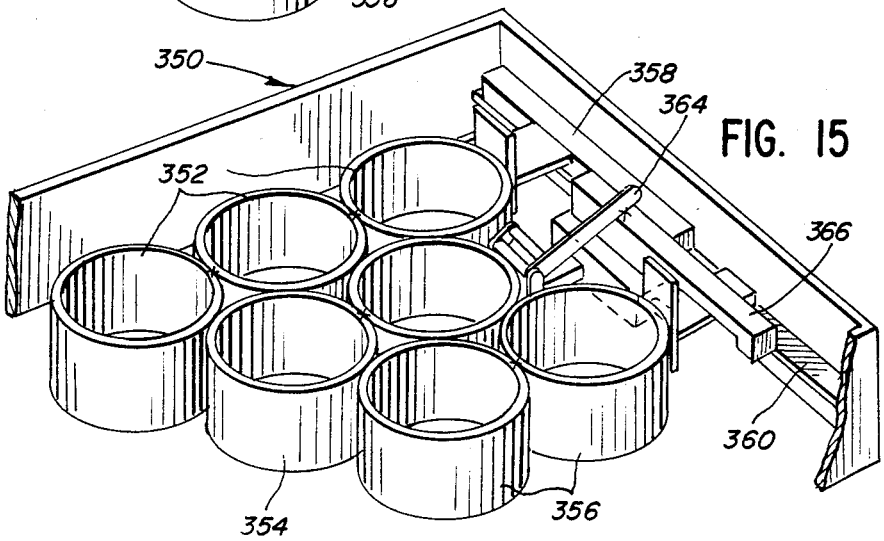
FIG. 15

AUTOMATIC CARTONING MACHINE AND METHOD FOR PACKAGING ARTICLES SUCH AS FRUIT

This invention relates to an automatic package forming machine, and particularly to a machine for automatically cartoning articles such as fruit in the cells of a protective expanded honeycomb. The machine and method produce a finished fruit containing carton automatically.

BACKGROUND OF THE INVENTION

It has long been recognized that articles such as fruit should be protectively packaged to prevent damage in shipping. Articles such as fruit are normally packaged in large containers. More recently, fruit, even such fruit as oranges and grapefruit, have been packaged in separate compartments in larger containers for damage free handling during shipping. By packaging in this manner the fruit can be shipped great distances without damage.

As is obvious, when packaging fruit it is desirable to maintain the fruit out of contact with each other so that during shipping they will not be abraded and seriously damaged by virtue of repeated rubbing against each other. When fruit is shipped over large distances, the fruit may be rubbed against each other literally thousands of times. This has resulted in substantial losses.

Typical packaging operations currently being employed pack fruits at random in a container after which the container is sealed and transported from where it is grown to the consumer. Whatever the distance travelled from orchard to consumer, whether it be dozens of miles or thousands of miles, the fruit does become damaged to some extent and in some instances the loss rate ran as high as ten, twenty and even thirty percent. This is obviously very disadvantageous from a cost standpoint.

Fruit has been manually packaged in trays, such as pulp trays, which of course is better than loose packing. This is expensive.

It is obvious that any method and apparatus capable of economically, efficiently and automatically packaging fruit while maintaining the fruit completely separate from each other would be very desirable. Such an arrangement prevents the substantial damage that inevitably occurs when boxes of fruit are subject to the abrading they receive when the boxes are shaken and jarred during transport.

It has long been recognized that if fruit were packaged in a manner such that they are totally separated from adjacent fruit by the utilization of honeycomb material that it would be highly advantageous. Honeycomb has been used for packaging but the use of such material has essentially been as part of a manual operation and this has been a slow and very costly procedure. Essentially this type of packing has been accomplished by manually expanding the honeycomb material and holding the honeycomb in an expanded position while the fruit is manually inserted. The industry has long been looking for a fully automatic, damage preventing, packaging system that is low in cost, operates at a high speed, and is relatively simple in design. The desired aim is to provide total internal protection for the product being packaged. That is to say, the article must be protected from pressures that would act to bruise or crush the product. A machine that can automatically package products in honeycomb capsules at low cost, high speed and efficient manner would be the answer to a long-felt need.

The advantage of using honeycomb material is that it provides a very strong configuration and has a very high strength to weight ratio compared to other products on the market. The high column strength of honeycomb results in the loads carried by the honeycomb material being distributed over a series of braced columns. It is this inherent structural geometry that makes honeycombs such desirable material for use in packaging. The cells of the honeycomb material act to isolate the articles disposed therein from adjacent articles. In the instant application the honeycomb material is made up of a relatively high density Kraft paper, but it can, of course, be made of recycled paper, plastic, or other suitable materials.

One packaging machine that has made the use of honeycomb effective and advantageous is that shown in U.S. Pat. No. 4,233,802.

The present invention is capable of more effectively meeting industry needs in that it will automatically serve to load a carton with a layer of fruit, wherein each of the fruits will be encapsulated in its own cell and fully protected from damage by contact with other fruits in the container. To this end, a layer of fruit is both placed into cells of expanded honeycomb and the carton is then formed automatically about the fruit-filled honeycomb. This manner of packing within a carton results in a total encapsulation of the articles being packaged. It provides a completed carton which may be stacked, while substantially eliminating the possibility of damaging fruit contained in the bottom cartons of a stack of such cartons.

SUMMARY OF THE INVENTION

In accordance with this invention there is provided a machine for automatically cartoning articles in the cells of a protective expanded honeycomb. The machine comprises means receiving a carton blank at a loading station, means for receiving and for expanding a honeycomb blank into an expanded honeycomb having a plurality of open cells at the loading station directly above said carton blank, and means for depositing individual articles such as fruit in said cells, thereby to provide an article filled honeycomb supported on the carton blank. The machine further comprises means for forming the carton blank into a base portion which supports the article filled honeycomb and into side portions and end portions which closely embrace the sides and ends of the article-filled honeycomb.

The machine includes support means for holding a stack of carton blanks and means for moving the carton blanks one at a time into the loading station, as well as support means for supporting a stack of honeycomb blanks, and means for moving honeycomb blanks, one at a time, into the loading station and for expanding the honeycomb blank to provide said open cells directly over a central portion of the carton blank.

The honeycomb blank expanding means preferably comprises means for supporting the honeycomb blank in the loading station and for gripping opposite sides thereof, and means for separating the gripping means, thereby to expand said honeycomb blank into the expanded open-celled condition.

The gripping means, in the preferred form, comprise suction means.

The article depositing means desirably includes a downwardly inclined conveyor and a downwardly opening chute for receiving articles from the conveyor. The chute defines a throat through which the articles move downwardly. The depositing means further includes means for automatically transferring articles downwardly from the chute into the cells.

The article transferring means comprise spotter means, such as spotter cups, for locating the articles in rows corresponding to the rows of the honeycomb cells, and means for traversing the cells with the spotter means, sequentially to fill the rows of cells with the articles. In a preferred form, means for moving the spotter cups between open and nested portions are provided, the spotter cups being adapted to receive articles in the open position from the chute and being adapted, when in the nested position, to deposit articles in the cells.

To facilitate depositing of the articles a support tray conjointly moveable with the spotter means and underlying the spotter cups is provided to support and return the articles in the spotter cups. After the articles are positioned in the cups and they are disposed over the cells, the support tray is withdrawn relative to the spotter cups, thereby to deposit the articles in the cells.

To facilitate downward transfer of the articles, the chute throat comprises a restrictor means moveable between an article passing position and an article retaining position, and means are provided for moving the restrictor means to the article passing position when articles are to be deposited in the spotter cups.

The carton forming means includes folder means for engaging the bottoms of peripheral portions of the carton blank and for folding them upwardly about said article filled honeycomb to form carton side portions and carton end portions integral with a carton blank base portion. The forming means also includes edge flap folding means for folding edge flap portions of the carton end portions into engagement with the said carton side portions. In the preferred form to secure the edge flap portion to the side portions, means for depositing adhesive in selected zones of the edge flap portions are provided so that when the edge flap portions are folded into engagement with the carton side portions, they will adhere to each other.

The forming means further comprises framing means for framingly embracing the sides and ends of the article filled honeycomb, against which the former means folds the carton side portions and carton end portions. Means for retracting the framing means from the completed carton are provided.

Preferably the forming means operates to form the carton about the article filed honeycomb in a forming station remote from the loading station. To that end, means are provided for moving the framing means into the loading station over the article filled honeycomb and for moving the framed, embraced article filled honeycomb and the carton blank into the forming station and over the folder means at which the folder means completes the carton forming as already set forth.

The automatic cartoning method of this invention includes the steps of positioning a foldable carton blank at a first station, disposing an expanded honeycomb defining a plurality of open cells over the blank, depositing articles in the cells to form an article filled honeycomb on the blank, and forming the carton blank into a base portion and side portions and end portions closely embracing the sides and ends of the article filled honeycomb, thereby automatically to form a self-supporting article containing carton.

Thus, this invention provides an improved, fully automatic machine and method for taking articles, such as fruit, which require or benefit from the protection of honeycomb and, from fruit, a flat carton blank and an unexpanded honeycomb blank form a completed, honeycomb filled single layer carton protectively containing the fruit.

Further objects, features and advantages of this invention will become apparent from the following description and drawings of a presently preferred embodiment of this invention.

BRIEF DESCRIPTION OF THE DRAWINGS

FIG. 1 is a top perspective view of a package forming assembly of this invention;

FIG. 2 is a top perspective view of a package assembled and filled on the assembly of FIG. 1;

FIG. 9 is a fragmentary perspective view of the honeycomb blank dispensing mechanism taken along line 9—9 of FIG. 1;

FIG. 10 is a fragmentary perspective view of the honeycomb blank expanding mechanism of FIG. 1;

FIGS. 12 and 13 are fragmentary perspective views of the fruit depositing chute of FIG. 11;

FIGS. 14 and 15 are fragmentary perspective views of the fruit spotter cups of FIG. 11;

GENERAL ORGANIZATION OF THE PACKAGE FORMING MACHINE

Figure 3:
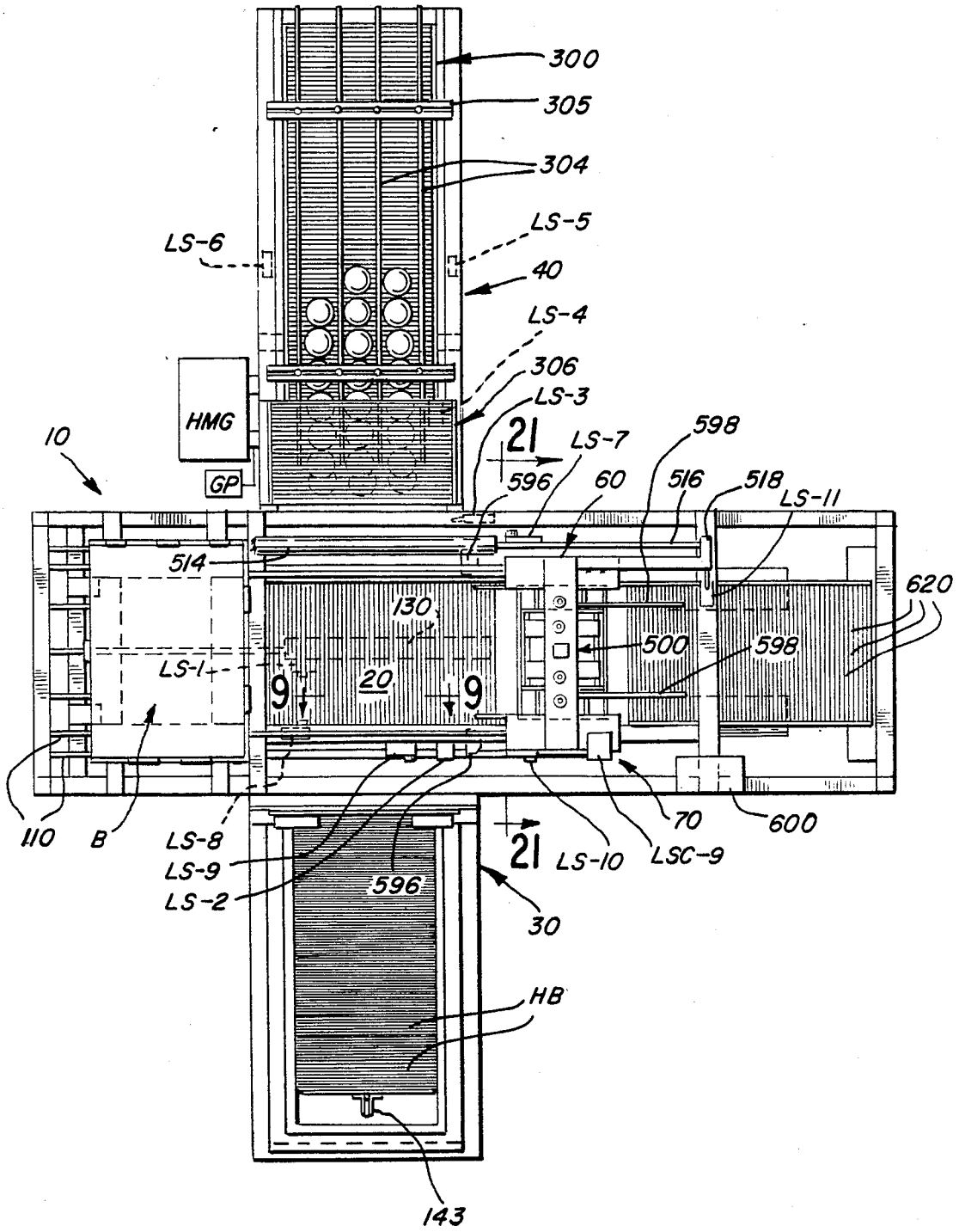
FIG. 3 is a plan view of the assembly of FIG. 1.

Before referring in detail to the several stations and subassemblies, it will be of benefit to discuss them generally to provide an overall understanding of the major components of the automatic cartoning machine 1 of this invention. A completed package P which machine 1 is adapted to form is shown in FIG. 2.

In this regard, FIGS. 1, 3, 4 and 5, which are a perspective view, a plan view, end view and side view of package forming machine 1 will be referred to first.

First, a carton blank loading station 10 is provided to support a stack of suitable carton blanks B. Blanks B are adapted to be stripped from the bottom of the stack, one at a time, and to be moved laterally (in the direction of the arrow in FIG. 1) onto a series of supporting rollers comprising central loading station 20 (see FIG. 3). Locators for precisely locating and maintaining the blank B in the station 20 are provided.

A honeycomb blank dispensing station 30 is provided. Station 30 maintains a stack of vertically disposed honeycomb blanks HB which are fed forwardly in the direction of the central loading station 20 (see FIGS. 1 and 3) and which are stripped off, one at a time, by a guillotine knife 142 which thrusts the honeycomb blank HB downwardly to be vertically disposed and suitably juxtaposed with respect to a carton blank B. The honeycomb blank is later gripped from opposite sides, as by vacuum operated expander trays 150, 200, and is pulled open to an expanded, open-celled honeycomb configuation directly overlying a central base portion of the carton blank B, within the periphery of the blank B, and at a predetermined, desired position to receive fruit in the cells.

Figure 20:
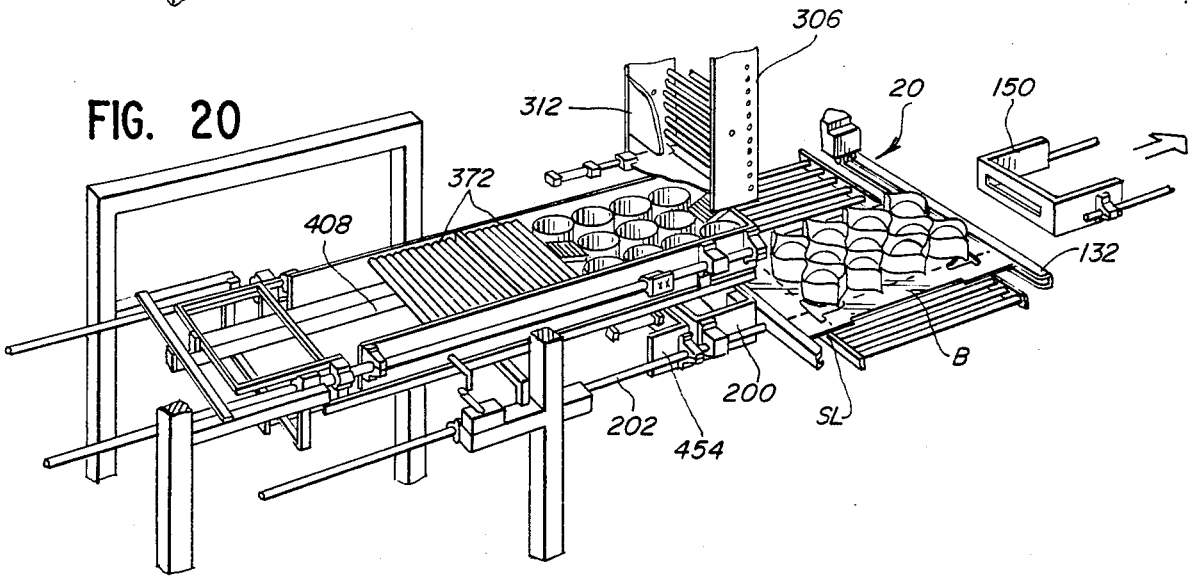
FIG. 20 is a view like FIG. 19 with the honeycomb blank expander tray retracted, leaving the fruit-filled expanded honeycomb and juxtaposed carton blank in the central loading station.

Articles, such as fruit of which grapefruit is exemplary, to be deposited in the expanded honeycomb cells, is introduced through a fruit loading and depositing mechanism 40. Mechanism 40 includes a driven roller conveyor 300, and a generally L-shaped discharge chute 306 which terminates downwardly adjacent a reciprocatable fruit depositing assembly. Mechanism 40 further includes a roller tray 380 and a spotter tray 350 (FIG. 14) having a series of appropriately located fruit spotter cups 352, 354, 356 adapted to receive the fruit from the discharge chute. The roller tray is adapted to underlie the spotter tray to maintain the fruit in the spotter tray. The roller and spotter trays are adapted to be moved to overlie the expanded honeycomb with the fruit in the spotter cups overlying the honeycomb cells. When the fruit is to be deposited in the honeycomb cells, the roller tray is retracted relative to the spotter tray (from the position of FIG. 17 to that of FIG. 18) and the fruit drops through the spotter cups into the honeycomb cells. After the fruit has been deposited in the cells, the honeycomb is released to provide an article or fruit-filled honeycomb on the carton blank, and the fruit loading and dispensing mechanism and expander trays are retracted to positions in which the central loading station 2 is unobstructed (as shown by FIG. 20).

Figure 4:
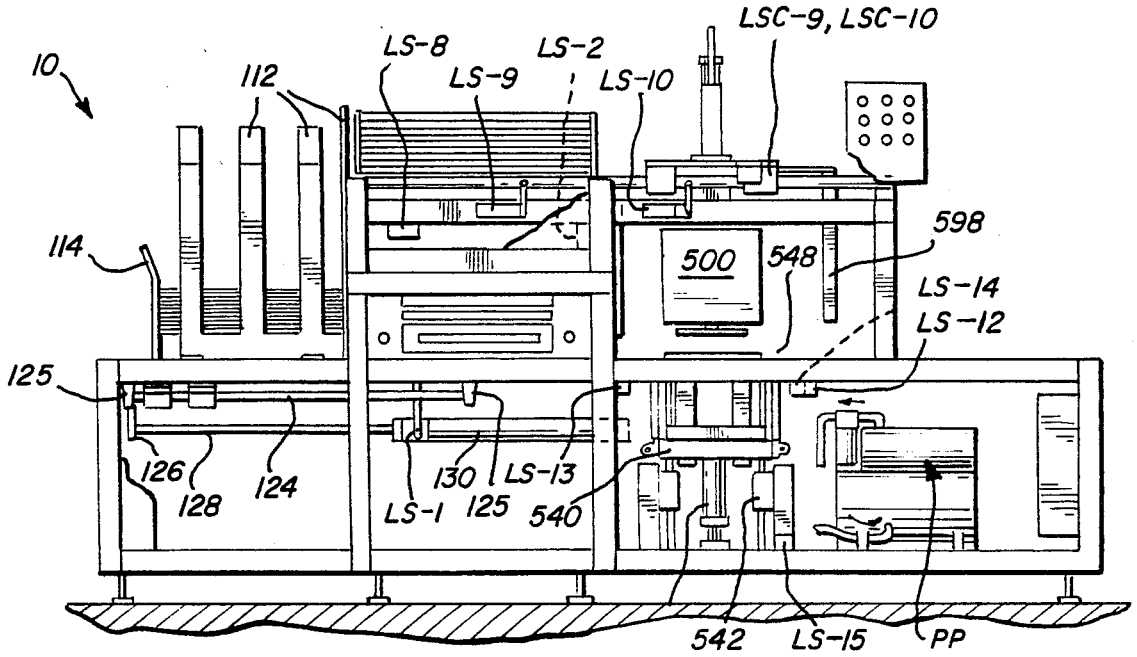
FIG. 4 is an end view of the assembly of FIG. 1.

Thereafter, the upper head portion of the package forming assembly 60 is moved from the position shown at the right in FIG. 3 laterally to overlie the blank B and the article filled honeycomb in the central loading station 20. The upper head portion 500 of the assembly 60 is then actuated to bring four mandrel flaps against the sides of the expanded honeycomb and fruit, and closely adjacent the carton blank B, thereby to framingly embrace the sides and ends of the article-filled honeycomb. That upper portion 500 and honeycomb and fruit and blank B are then conjointly moved to the right (as seen in FIGS. 3 and 4) to the package forming station 70. During that movement between the central loading station 20 and the package forming station 70, adhesive is deposited on selected carton blank flap zones.

At the package forming station 70 shown in FIG. 4, forming rollers are moved upwardly to fold portions of the carton blank B into side portions and end portions integral with, and at 90° to, the central base portion of the carton blank. Additional rollers bend and fold edge flap portions EF of the carton blank into contact with side portions of the carton blank where the interposed adhesive serves to bond those portions to each other, thereby to form a carton about the honeycomb and fruit, hence to provide a package P. Thereafter, the folder rollers are retracted, as to the positions shown in FIG. 22, and the flaps of the mandrel assembly are retracted upwardly from between the fruit and honeycomb and the box sides and ends, as to a position like that shown in FIG. 21. The finished fruit package P is then ready to be discharged, as by suitable pushers, along discharge rollers out of the fruit package forming station 70.

Carton Blank Loading Mechanism

Figure 7:
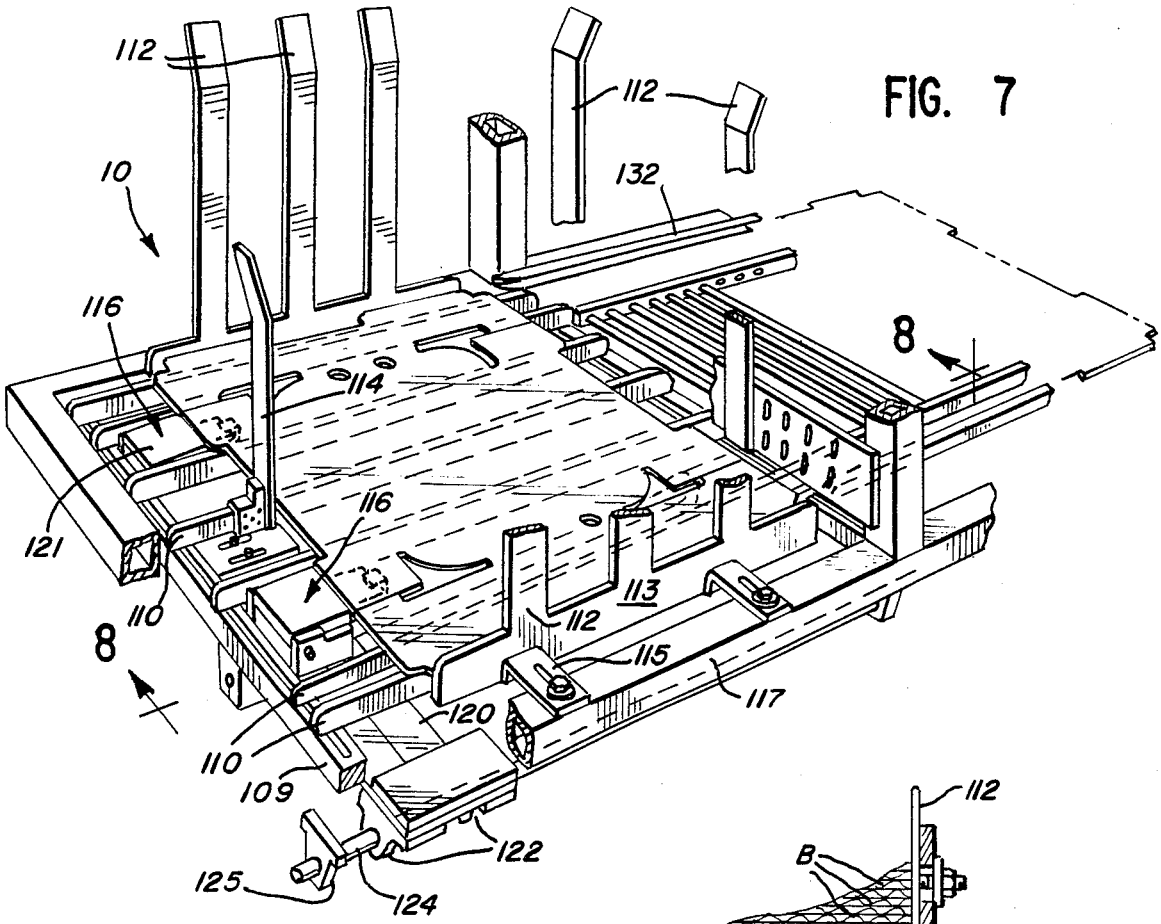
FIG. 7 is a fragmentary perspective view of the carton blank loading station of FIG. 1.

Referring now to FIGS. 1, 3, 4, 7 and 8, the carton blank loading station 10 comprises a series of support rails 110 upon which a stack of carton blanks B are supported. Rails 110 are laterally adjustable via threaded studs 111 clampingly engaging a slotted locator bar 109 disposed at each end of the rails 110. At the sides of the stack and at the front of the stack, upstanding locater fingers 112 are provided. At the rear of the stack, a rear locater finger 114 is provided. These are positioned to snugly receive and precisely locate the container blanks B on the rails 110. The side fingers 112 may be laterally adjustable and may be integrally formed as shown in FIG. 7 where three fingers 112 are shown formed with a base 113 to which slotted brackets 115 are secured for lateral adjustment on side rails 117. Finger 114 is mounted for longitudinal adjustment on a rail 110

Figure 8:
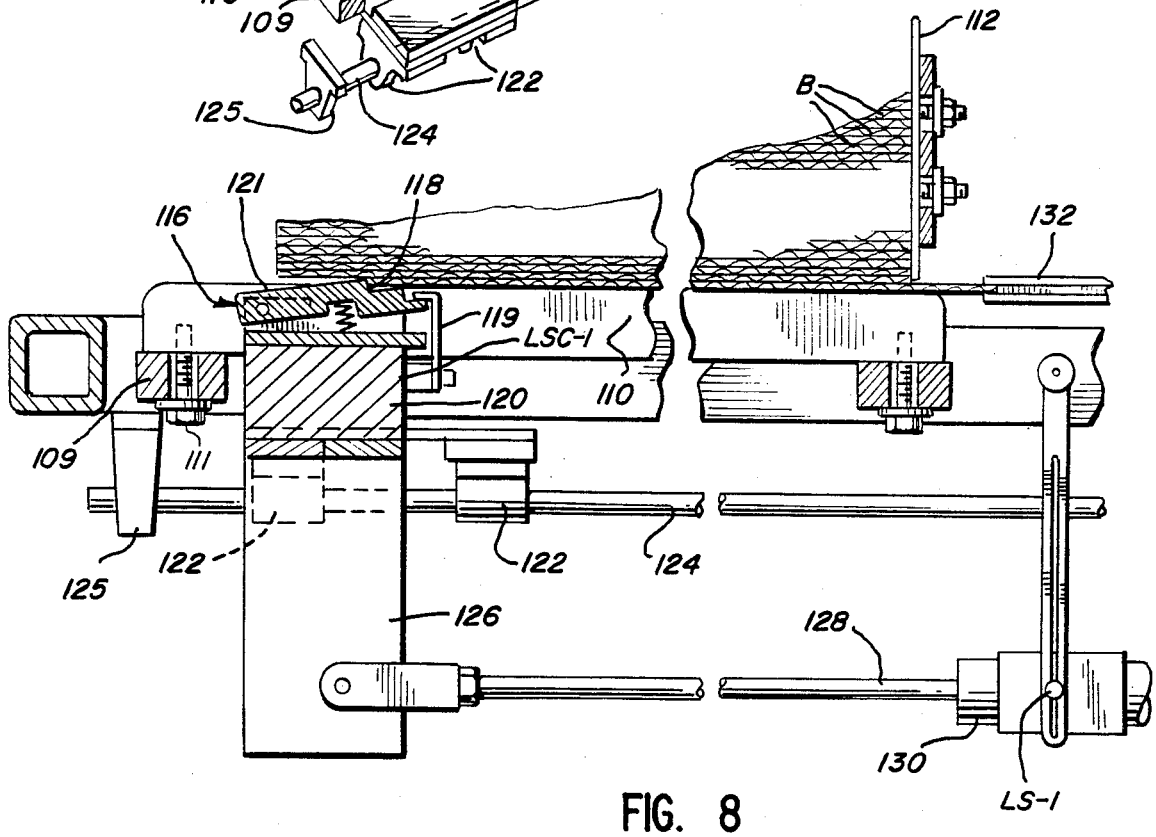
FIG. 8 is a fragmentary sectional view taken substantially along line 8—8 of FIG. 7.

A stripper mechanism is provided at the base of the stack of blanks B between support rails 110. The stripper mechanism may comprise a pair of spaced stripper fingers 116 which are spring biased upwardly above support rails 110 a distance slightly less than the thickness of the carton blanks B. The vertical extension is controlled by an adjustable clip 119 adjustably disposed at an elevation consistant with the thickness of the carton blank. As shown in FIG. 8, the stripper fingers 116 are positioned so that their stripper faces 118 may be moved forwardly to engage an edge of a carton blank B.

As seen in FIGS. 7 and 8, the upper surfaces 121 of the stripper fingers 116 are inclined rearwardly so that upon the return stroke, the stripper fingers will ride under the then lowermost carton blank without pushing it rearwardly. Stripper faces 118 are adapted to push the container blank B forwardly to a predetermined position in the central loading station 20. To that end, the stripper fingers 116 are suitable mounted on a bar 120 which in turn is fixed to pillow blocks 122. Pillow blocks 122 are mounted to slide on guide rods 124 (one at each side) which are secured to the frame by clamps 125.

Bar 120 is secured to a drive plate 126 to which is connected a pneumatic drive cylinder and piston assembly comprising rod 128 and cylinder 130 (FIGS. 4 and 8). A limit switch contactor LSC-1 is positioned to engage the limit switch LS-1 at an appropriate time. Unless otherwise noted, all of the cylinders are pneumatically operated and are provided with conventional valves which are electrically operated in a known manner in response to electrical signals generated by the limit and other switches.

As the blank B is moved toward the central loading station, its edges are moved into U-shaped tracks 132 which confine, guide and locate the edges of the blank precisely as desired in the central loading station (see FIGS. 7 and 8). Thus the carton blanks B are moved one at a time from the station 10 to the central loading station 20.

The Honeycomb Blank Dispensing and Expansion Mechanisms

The honeycomb blank dispensing station 30 illustrated generally in FIG. 1 is best seen in FIGS. 1, 2, 9 and 10. The honeycomb dispensing mechanism operates generally in accordance with the teachings of U.S. Pat. No. 4,233,802. To that end the dispensing mechanism comprises a tray in which a stack of blanks of compressed honeycomb HB (sometimes called tapes) are vertically positioned and supported and biased forwardly by a cylinder operated follower 143 (FIG. 1). One at a time the blanks HB are forced downwardly at the forward end of the tray 140 by a guillotine knife 142 which is suitably mounted for vertical reciprocating movement by a cylinder and piston assembly 144, one at each side of the knife. Thus, the forwardmost honeycomb blank HB is pushed downwardly to the elevation of the honeycomb expanding and positioning mechanism. As the honeycomb blank is pushed downwardly it is initially retained between faces 145 at the forward end of the expander tray 150 and oscillatable keepers 146 pivotally mounted on expander tray 150. Support feet 151 serve to support to blank HB at the selected, predetermined elevation.

Expander tray 150 is initially positioned in a retracted position beneath the guillotine knife 142 to receive the blank HB on projecting feet 151, and between faces 145 and keepers 146. Feet 151 are elevated sufficiently so that the blank B may be disposed in the U-shaped tracks 132 therebelow. Expander tray 150 comprises gripping means including two laterally spaced, vertically disposed pairs of vacuum or suction cups 156, 158. One vertical pair may be mounted for oscillation on a support rod, in the manner to be described relative to expander tray 200. The suction cups 156, 158 are mounted on rods 164 which project through a slot 166 in tray plate 168.

Expander tray 150 is adapted to move from the retracted blank receiving position of FIG. 9 to the extended position of FIG. 10 in which the honeycomb blank HB is properly positioned over one side of the blank B. As seen in FIGS. 9 and 10 the U-shaped tracks 132 are adjustably mounted on straps 133 which are secured to the frame by suitable fasteners and which hold the tracks 132, hence the blank B, in the loading station at a predetermined desired location. The honeycomb blank and tray is brought forward over the blank B to the desired position by a tray cylinder 170 which is secured at its forward end to a cylinder mounting plate 172. The tray 150 is supported by tray rails 174 secured by clamps 175 to the tray. The tray 150 may move relative to frame mounted pillow blocks 176.

As will be seen in FIGS. 9 and 10, each keeper 146 is mounted on a pivotally mounted angled bracket 178 which is located to contact a cam 180. When the tray 150 moved forward, the cam acts against the bracket 178 to retract the keeper (see FIG. 10). When the tray moves rearwardly, the keeper 146 is cammed to the blank HB retaining position of FIG. 9.

The other honeycomb blank expander tray 200 is mounted for movement toward and away from tray 150. Tray 200 is mounted for movement along rods 202 on pillow blocks 204 in a manner to be described. Tray 200 includes gripping means comprising spaced vertical pairs of suction cup assemblies 206, 208 having suction cup rods 210, 212, respectively. The rods 210, 212 extend through a guide slot 214 in tray plate 216. The rods 210 are mounted to the support rod 218 via a block 220 which is pivotably supported on rod 218. Vacuum is drawn through conduits 222. Cups 156 may be similarly mounted for oscillation, as may be cups 158, 208 as well, even though that may not normally be necessary.

The suction cup assemblies 156, 206 confront each other on substantially the same elevation and suction cup assemblies 158, 208 confront each other, also substantially on the same elevation. Each of vacuum conduits 222, as well as like vacuum conduits (not shown) for the cups 156, 158 and 208 are connected to a vacuum source, such as one or more vacuum pumps PP (FIG. 4). The suction cups are operable substantially in the manner described in U.S. Pat. No. 4,233,802, the disclosure of which is incorporated here by reference.

After the honeycomb blank HB has been juxtaposed on support feet 151, and at appropriate times to be described, the tray 150 is moved forwardly and its suction cups are actuated. The tray 200 is moved forwardly and its suction cups grip the other side of the honeycomb blank. Thereafter tray 200 is retracted to effect expansion of the honeycomb blank into the open celled, expanded honeycomb configuration desired over the central portion of the blank B so that the cells may receive the fruit to be deposited in the cells and so that the blank B may serve as a support.

As expansion of the blank occurs, a pure linear movement of the suction cups will not attain the desired result since, when the honeycomb is expanded, its width is reduced. Compensation must be made for this circumstance during the expansion process. Thus, the pivotally mounted suction cup assemblies 156, 206 oscillate, thereby to accommodate width reduction of the blank HB as it moves to the open-celled condition overlying the blank B.

Fruit Loading and Depositing Mechanism

The fruit loading and depositing assembly 40 is shown in FIGS. 1, 3, 5, 6 and 11 to 20.

Figure 6:
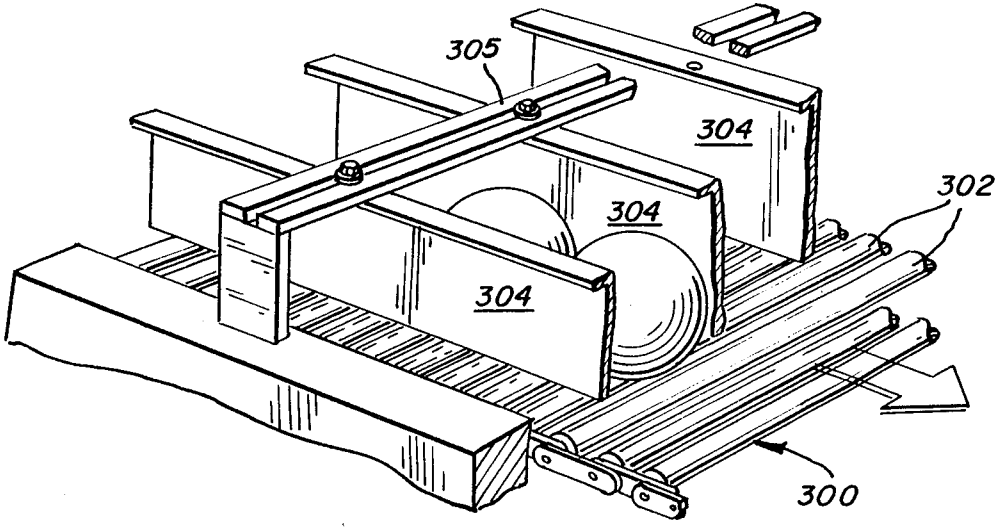
FIG. 6 is a top fragmentary perspective of a portion of FIG. 5.
Figure 5:
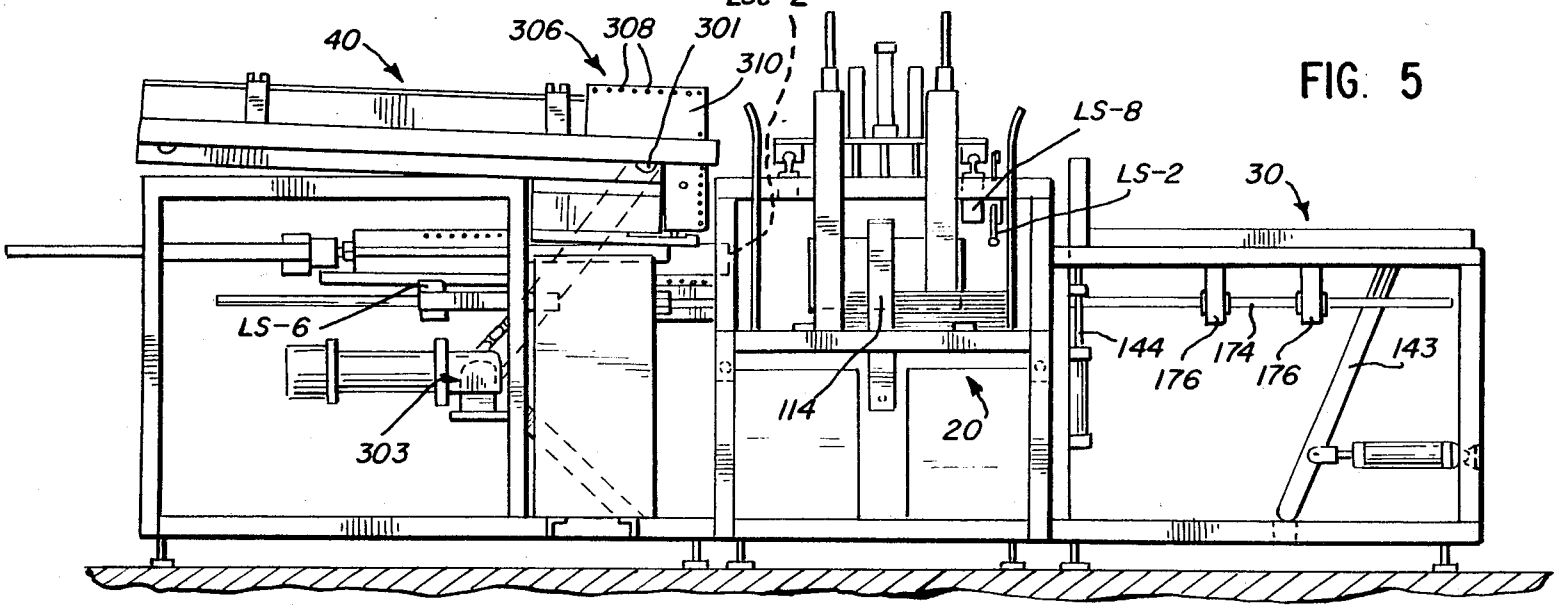
FIG. 5 is a side view of the assembly of FIG. 1.

Assembly 40 includes a downwardly inclined driven conveyor 300 (FIG. 1) and which comprises a series of spaced rotatably mounted conveyor rollers 302 (FIG. 6). The conveyor is driven by a sprocket 301 and associated motor, gear reducer and drive chain assembly 303 (FIG. 5). Lateral dividers 304 defining a predetermined number of rows are provided. Dividers 304 are laterally adjustable to accommodate to the size of the fruit to be packaged and are supported for that purpose via threaded fasteners on slotted hangers 305 (see FIG. 6). At the forward end of the conveyor 300, a downwardly opening conveyor chute 306 is provided. Chute 306 comprises a series of rollers 308, some of which are positioned above the end of conveyor 300 and some of which confront the forward end of the conveyor 300. Dividers 304 extend forwardly into the chute 306 to maintain the fruit properly laterally spaced until it is ready to drop vertically in the chute. Chute 306 also comprises lateral sidewalls 310 and a rear plate 312 which, with rollers 308, confine the fruit and guide it downwardly.

Several rollers 308A are mounted on oscillatable restrictor arms 314 located at each side of the chute 306. In the restricting position shown in FIG. 12 rollers 308A narrow the throat of the chute through which the articles pass downwardly to retain and hold back the forwardly moving rows of fruit. In the fruit passing position of FIG. 13, rollers 308A permit fruit to move through the chute throat and downwardly. Arms 314 are mounted on pivots 316 and are normally in the position of FIG. 13, the arms being urged to the throttling position by stop plate 318. When the stop plate 318 is retracted, as shown in FIG. 13, an interconnected tension spring 320 pulls on arms 314 which causes them to oscillate about their pivot points until stop fingers 322 engage a stop, such as roller 308, at the top of the chute 306.

Stop plate 318 is provided to open the bottom of chute 306 to permit the fruit to be discharged therethrough. Plate 318 is retracted and extended by a piston and cylinder assembly 324. The plate 318 is supported, as it moves between the positions of FIGS. 12 and 13, on slotted frame members of the assembly 40.

Figure 11:
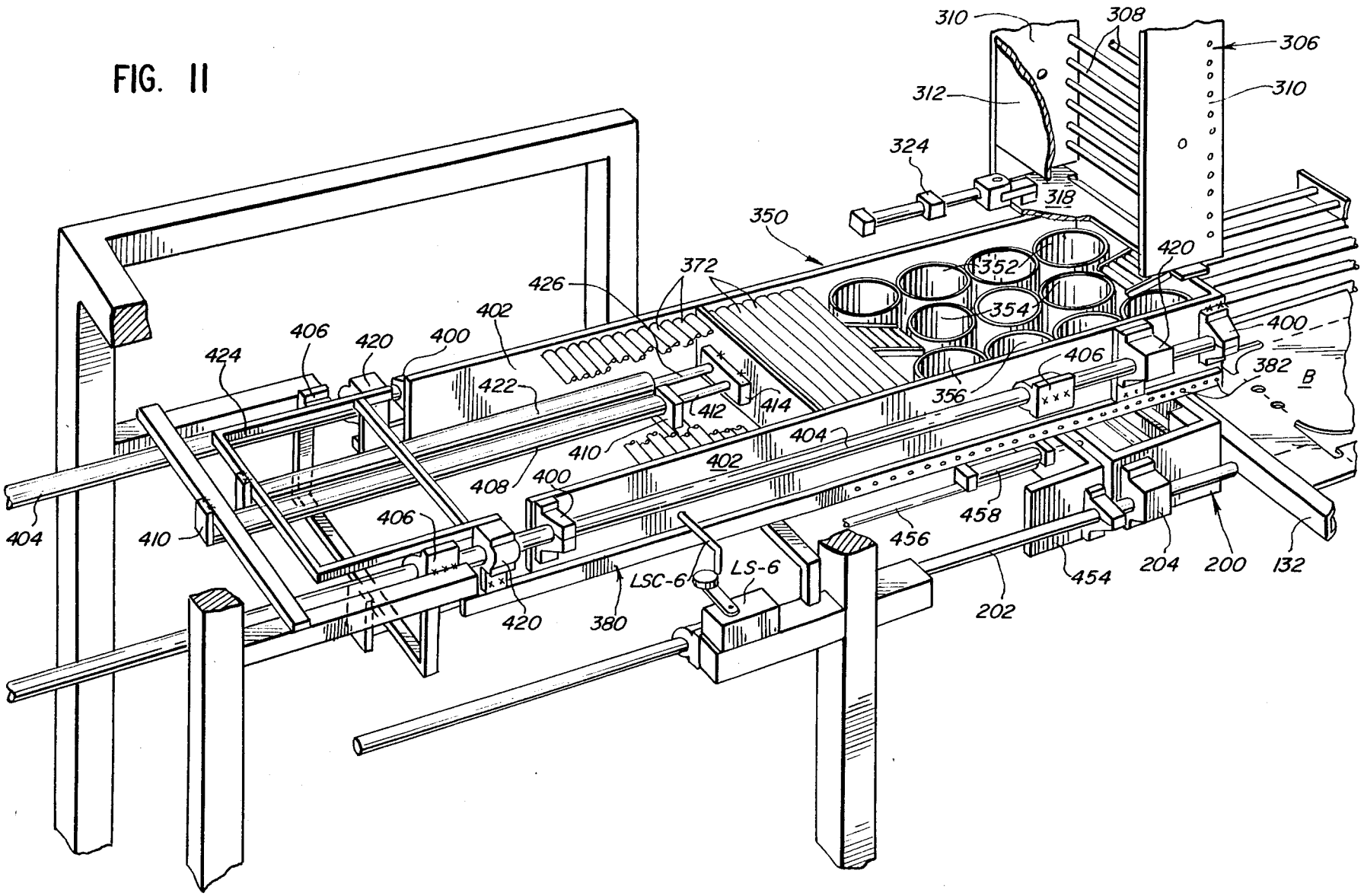
FIG. 11 is a partial perspective view of the fruit loading and depositing assembly of FIG. 1.

Assembly 40 further includes a spotter tray 350 which is adapted to receive the fruit from the conveyor 300 and chute 306 and to orient it for reception by the cells of the expanded honeycomb. As best seen in FIGS. 11, 14 and 15, spotter tray 350 includes a plurality of rows of spotter cups 352, 354 and 356. Each longitudinal row is preferably integrated, as by spotwelding so that it may be moved laterally conjointly as a row. As seen in FIGS. 11 and 14, the rows are laterally spaced to receive the fruit from chute 306. In FIG. 15 the rows are laterally nested and interdigitated in a configuration corresponding substantially to the spacing and relationship of the expanded honeycomb cells, thereby to locate the fruit in rows corresponding to the rows of the cells.

Figure 16:
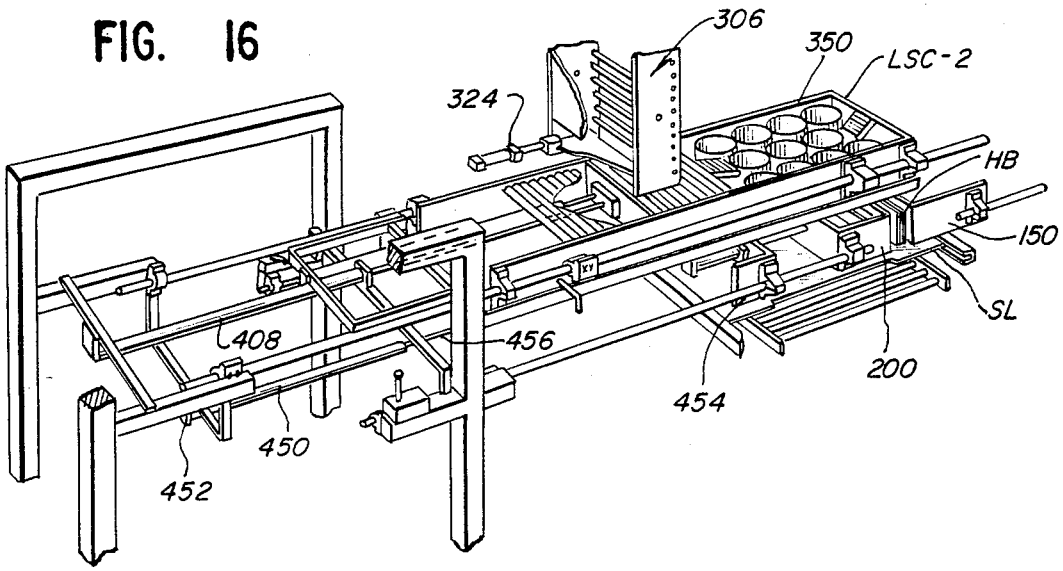
FIG. 16 is a perspective view of the assembly of FIG. 11 extended and juxtaposed with the honeycomb blank expanding mechanism.

As seen in FIGS. 15 and 16, the cups 352 are secured to slide bars 358 which rest on support plates 360 at the front and rear portions of the spotter tray. Cups 356 are secured to slide fingers 362 which are supported on support plates 360. Cups 354 are secured front and rear by connector rods 364 to a notched support bar 366 which is slidably supported on finger 362. A cylinder block 368 is also fixedly secured at each end of the row of cups 354. Block 368 is connected via piston rods 370 to the rows of cups 352, 356 so that those rows may be moved from the open, extended position of FIG. 14 in which fruit is received from the chute, to the retracted, nested position of FIG. 15.

A support or roller tray 380 is provided to control dispensing of the fruit from the spotter tray cups. Tray 380 underlies the spotter tray 350 and comprises a frame with a series of rollers 382 against which the fruit disposed in the cups 352, 354 and 356 rests and is supported until it is to be dropped into the expanded honeycomb cells.

The fruit loading and depositing assembly 40, together with expander tray 200, are normally in their laterally retracted positions shown in FIGS. 1, 3, 5 and 11. When the fruit is to be deposited, the spotter tray 350 and underlying roller tray 380, and the expander tray 200 are moved laterally from the position shown in FIG. 11 over the central loading station as shown in FIG. 16. Suitable cylinders and related structure are provided to extend and retract the spotter tray, roller tray and expander tray.

Referring now to FIG. 11, it is seen that spotter tray 350 is reciprocably mounted on the machine frame. To this end a pair of spaced clamps 400 are fixed to the spotter tray sidewalls 402 at each side. Clamps 400 embrace guide rods 404 (one at each side) which in turn are slidably received by pillow blocks 406 which are secured to the machine frame. A spotter tray cylinder 408 is also secured to the machine frame by supports 410. A spotter tray piston rod 412 extends from the cylinder and is secured at its free end to the block 414, which in turn is fixed to the spotter tray. Thus, when rod 412 is extended, the spotter tray moves to the right as seen in FIG. 11.

The roller tray 380 is also mounted and supported for movement along guide rods 404. To that end pillow blocks 420 are fixed at their lower ends to roller tray 380. The inner surfaces of the pillow blocks 420 confront the spotter tray sidewalls 402 and are adapted to slide therealong and relative thereto. The roller tray 380 is provided with a roller tray cylinder 422 having a piston rod 426 which is fixed at its free end to block 414. The opposite end of cylinder 422 is fixed via yoke 424 to a pillow block 420 and the roller tray 380.

When rod 412 is extended to the right (FIG. 11) the spotter tray moves to the position shown in FIG. 16, conjointly carrying with it the roller tray 380, the roller tray cylinder 422 and roller tray rod 426 retaining the relationship shown in FIG. 11. At the same time the expander tray 150 moves forwardly from the position of FIG. 9 to the position shown in FIGS. 10 and 16.

When the spotter and roller trays are moved to the right, the chute stop plate 318 is retracted by cylinder 324 and the fruit drops into the spotter cups 352–356 as previously described, filling each cup in the row. To prevent the fruit from dropping into the spotter tray after the cups pass the bottom of the chute 306, rollers 372 mounted rearwardly of the cups are provided.

The expander tray 200 also moves from the position of FIG. 11 to that shown in FIG. 16. To accomplish that an expander tray cylinder 450 is provided. One end of the cylinder 450 is secured to the machine frame at 452 (FIG. 16). The piston rod 456 extends from the other end and is fixed to expander tray element 454. As piston rod 456 reaches the maximum extent of its travel to the right, a secondary cylinder 458 (fixed at one end to element 454 with its piston rod 460 fixed to expander tray 200) is actuated to extend the expander tray 200 to its fully extended position confronting tray 150. When the suction cups are activated, the cups grip opposite sides of the honeycomb blank HB, and the piston rod 456 is retracted to expand the honeycomb, i.e., to the position shown in FIG. 17.

Then the spotter cups are nested, as described in connection with FIGS. 14 and 15, and the roller tray 380 is retracted, the latter by retracting cylinder 422. As the roller tray is retracted and withdrawn, to the position shown in FIG. 18, the now unsupported fruit drops from the nested cups 352-356 to be deposited in the underlying honeycomb cells. Upon completion of the depositing of the fruit, the spotter tray 350 is retracted to the position shown in FIG. 19 and the spotter cups are denested. Cylinder 458 is actuated to withdraw the tray 200 and the expander tray 150 is retracted, all as shown by FIG. 20. Fruit is again directed into the discharge chute 306 and the fruit loading and depositing mechanism is readied for the next cycle.

As shown by FIG. 20, the central loading station 20 has been freed of loading and dispensing mechanisms, and the carton blank and fruit filled honeycomb HCF are ready to be formed into a self-contained package.

The Package Forming Assembly 60

Figure 21:
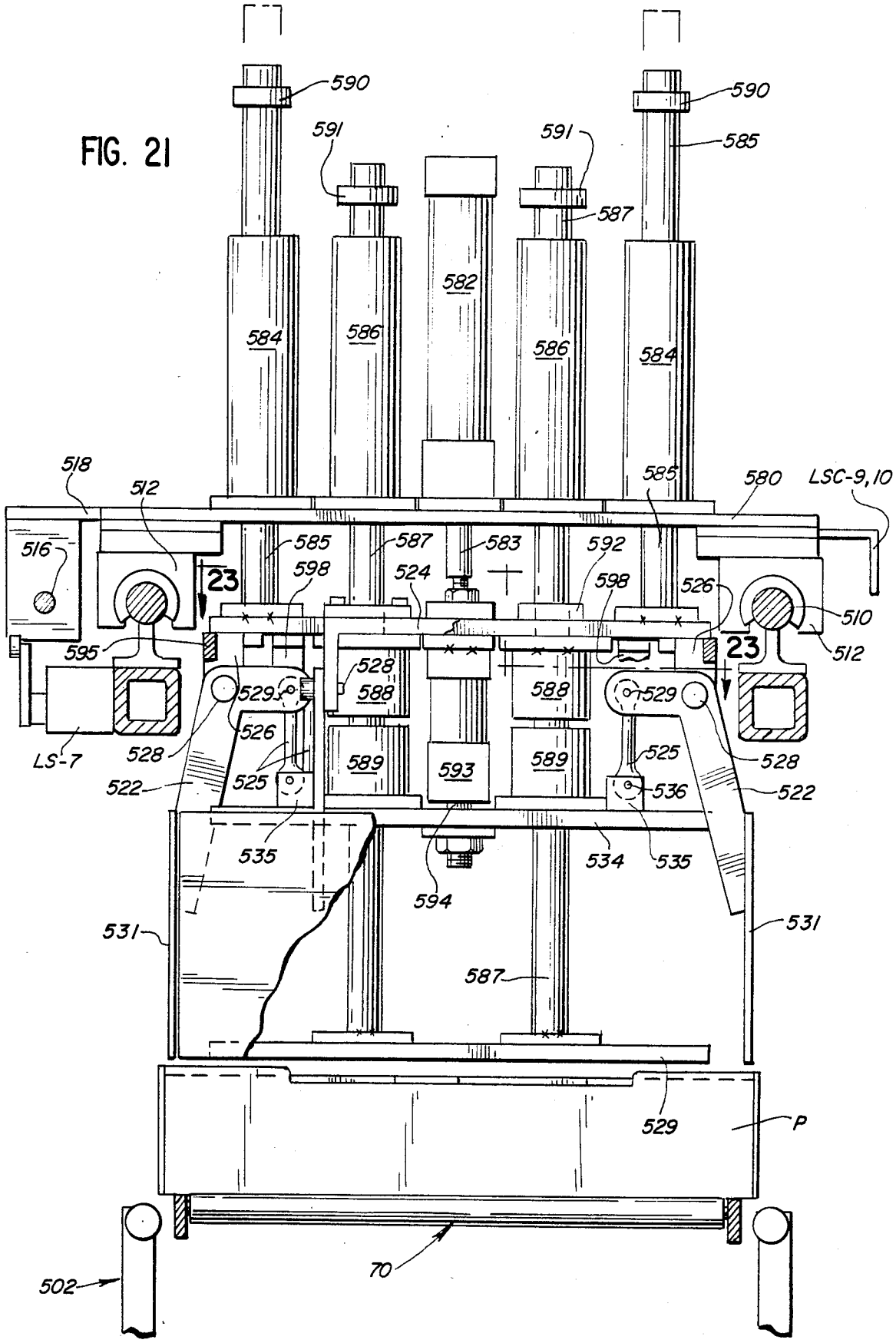
FIG. 21 is a side elevational view of the upper portion of the package forming assembly of FIG. 1 partially retracted after forming the package of FIG. 2, and taken generally along line 21—21 of FIG. 3.

Referring now to FIGS. 21–28, and first to FIG. 21, a completed package P is shown to be disposed in package forming station 70. The package forming assembly includes an upper head portion 500 (FIG. 21) and a lower roller assembly 502 (see FIG. 22).

Upper head portion 500 is mounted on rails 510 secured to the frame for movement between stations 20 and 70. Head 500 mounts slide guides 512 which embrace rails 510 and which are movable along rails 510 by a head cylinder 514 and piston rod 516 (FIG. 3). Cylinder 514 is fixed to the frame at one end and piston rod 516 is fixed at its free end to a bracket 518 which in turn is secured to head 500 to move it to the loading station 20.

Head 500 comprises a mounting plate 580 which is fixed with the slide guides 512. Plate 580 fixedly mounts a cylinder 582, a pair of control plate guide sleeves 584 and a pair of fruit hold-down plate guide sleeves 586. Control plate guide sleeves 580 slidably receive control plate rods 585 and sleeves 586 slidably receive fruit hold-down plate rods 587. The ends of the rods 585 are fixed with control plate 524.

Fruit hold-down plate rods 587 project through the control plate 524, through control plate sleeves 588 which are fixed to control plate 524, through flap control plate 534 (and flap control plate sleeves 589) and into fixed engagement with the fruit hold down plate 529.

Guide rods 585 mount stops 590. Guide rods 587 mount upper stops 591 and lower stops 592 for a purpose to be described. All of the stops may be longitudinally adjustable on their respective rods.

Figure 26:
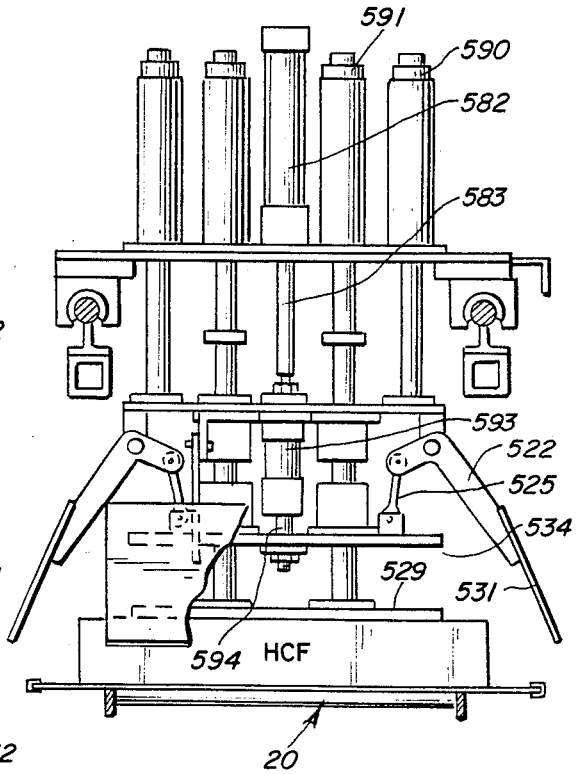
FIG. 26 is a view similar to FIG. 25 with the carton flap mandrels in positions ready to embrace the honeycomb and fruit.

As seen in FIG. 26, the head portion 500 has been moved to the fruit loading station 20. The control plate 524 is there shown in its uppermost position, with the flap control plate 534 and fruit hold-down plate 529 in their uppermost positions. The stops 590 and 591 are in their full up positions and the piston rod 583 of cylinder 582 is in the fully retracted position. Lower stops 592 bear against control plate 524 holding the fruit hold-down plate 529 in an elevated position. In this position head 500 overlies the expanded honeycomb assembly and blank B.

Cylinder 582 is then actuated driving piston rod 583 downwardly to the position of FIG. 26. Rod 583 carries the control plate 524 downwardly allowing the fruit plate 529 to drop by gravity until it rests against the top of the honeycomb and fruit. The upper stops 591 bear against the upper ends of sleeves to control the amount of weight the plate 529 is allowed to apply to the fruit. Stops 590 also serve to limit, with rod 583, the extent to which the control plate 524 is permitted to descend.

The carton forming mandrel end mandrel flaps 531 and side mandrel flaps 532 are operated by a flap control cylinder 593 and flap control piston rod 594. Cylinder 593 is secured to the control plate 524 and piston rod 594 is secured to the flap control plate 534.

Figure 25:
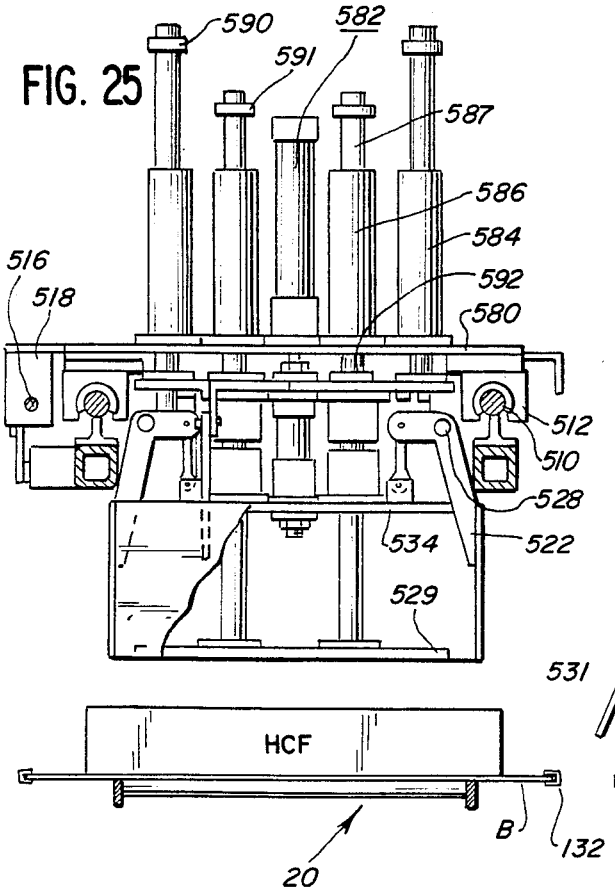
FIG. 25 is a view like FIG. 21 with the upper portion of the package forming assembly in fully retracted upper position, above the honeycomb and fruit in the fruit loading station.

Each flap 531, 532 is mounted to oscillate between the positions of FIGS. 25 and 26. To that end, each flap is fixed to a pair of generally L-shaped brackets 522 mounted for oscillation at a central region about a pivot rod 528. Pivot rod 528 is fixed to control plate 524 by a mounting plate 526. The other end of each L-shaped bracket 522 is secured to a lever 525, as by a pin 529. Lever 525 is fixed at its other end to the flap control plate 534 by a flap control bracket 535 and pin 536. Pins 529 and 536 accommodate oscillation of the lever 525 between the position shown in FIGS. 25 and 11 and that shown in FIG. 26.

Thus, it will be understood as piston rod 594 is moved from the retracted position of FIGS. 11 and 25 to the extended position of FIG. 26, the plates 524 and 534 will separate, oscillating the flaps 531 and 532 about pivot rods 528 thereby positioning the flaps to embrace the honeycomb-fruit assembly HCF.

Figure 27:
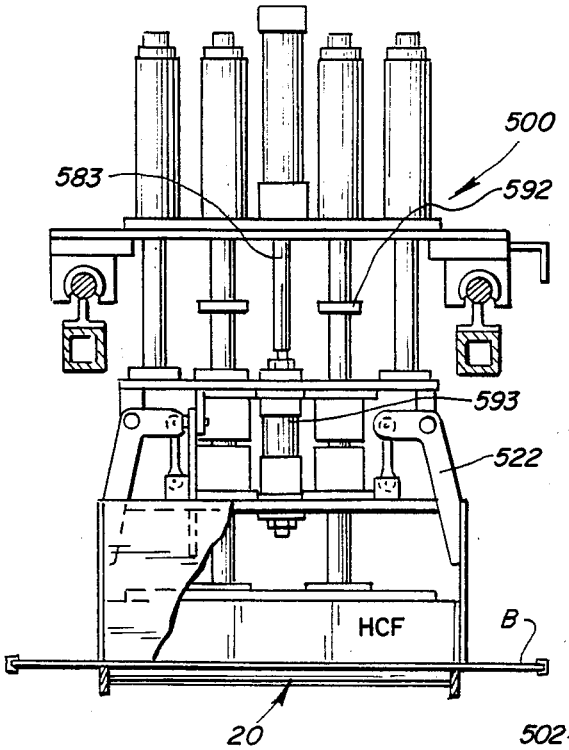
FIG. 27 is a view similar to FIG. 26 with the carton flap mandrels in an embracing relationship with the honeycomb and fruit in the fruit loading station.

The flaps 531, 532 are then moved from the inclined, extended or open position of FIG. 26 to the closed position of FIG. 27. This results in compression of the extended free edges of the honeycomb to the compressed condition shown in FIG. 27 and provides a rectangular frame which framingly embraces the sides and ends of the honeycomb-fruit assembly HCF. The retraction of the flaps 531, 532 is effected by the retraction of piston rod 594, thus again elevating the flap control plate 534 relative to control plate 524 and reversing the action of the flaps. Since the fruit hold-down plate 529 is gravity biased downwardly and supported on stops 591, hold-down plate 529 remains against the honeycomb as shown by FIG. 27.

The assembly HCF and underlying carton blank B are then ready to be moved from station 20 to station 70 by piston rod 516. Head 500 also mounts a pair of carton blank fingers 595 which depend from the front of the head 500 and engage the edge of blank B so that as the honeycomb assembly HCF is pulled towards station 70, so also is blank B.

Further, as the blank B is pulled toward station 70, adhesive, such as hot melt glue, contained in container HMG (FIG. 3) is suitably dispensed by a glue pump GP onto selected zones of the carton edge flap portions by glue heads 596. After the head 500 reaches its package forming position at station 70, the lower roller forming assembly 502 is activated, as illustrated generally in FIG. 28 and in greater detail in FIGS. 22 and 24.

Figure 22:
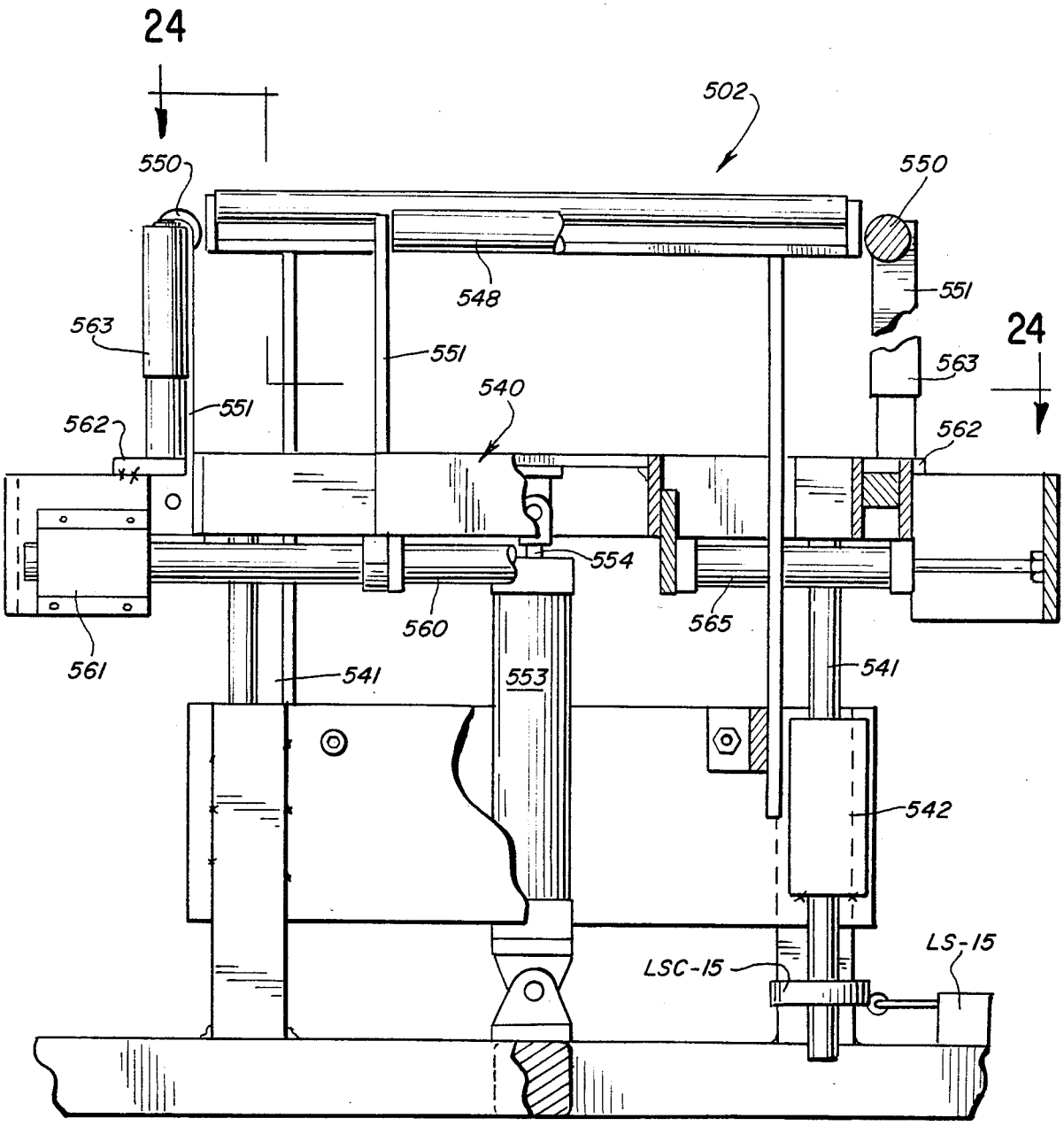
FIG. 22 is a side elevational view of a lower portion of the package forming assembly of FIG. 1 viewed from line 21—21 of FIG. 3.
Figure 23:
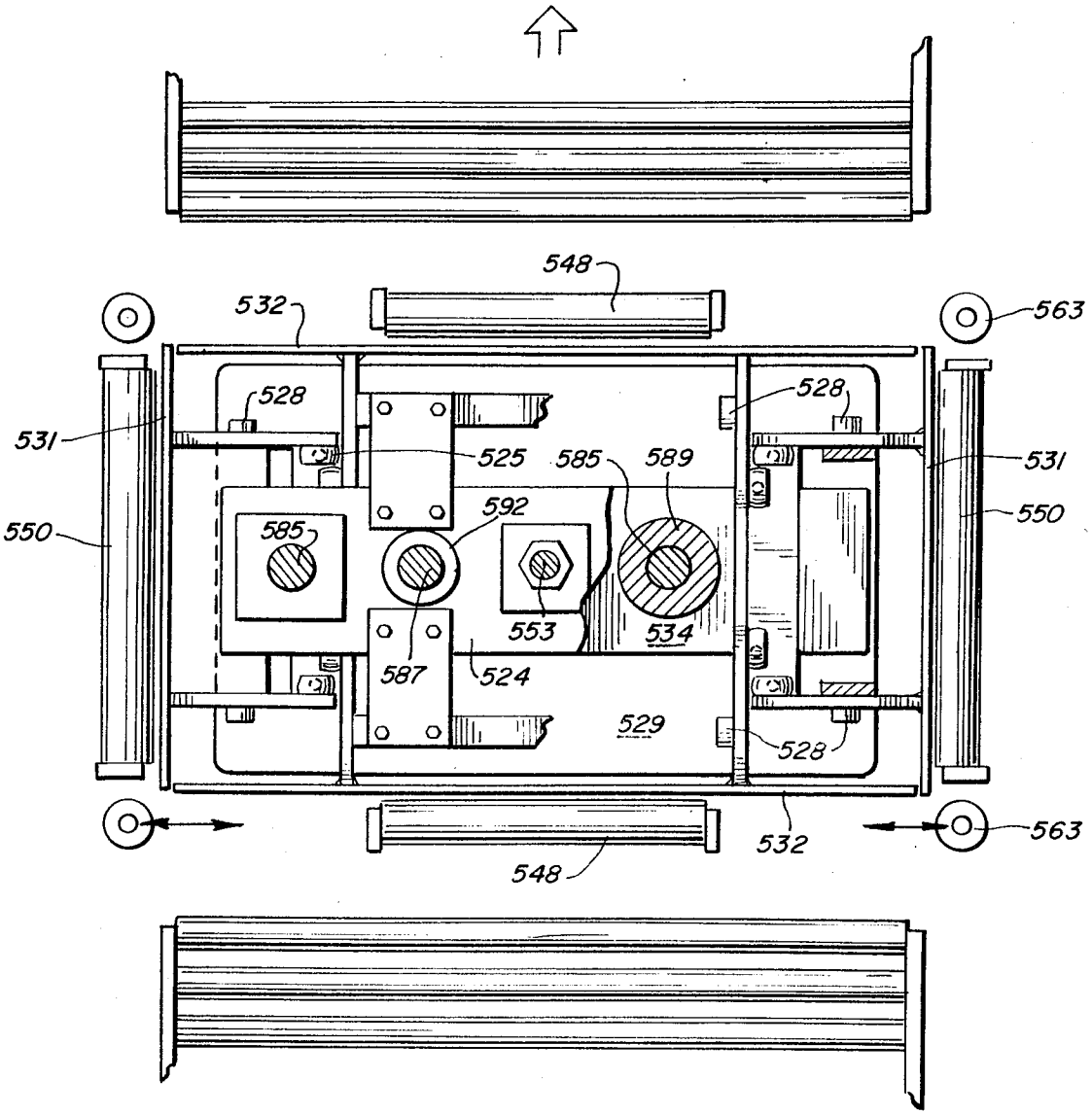
FIG. 23 is a cross-sectional view taken along line 23—23 of FIG. 21.

The roller forming assembly comprises a flap roller cylinder 553 which is fixed at one end to the machine frame (see FIG. 22). The free end of piston rod 554 is a flap roller support frame 540. When piston rod 554 is extended, it is guided by guide rods 541 slidably mounted in pillow blocks 542 which are supported on the frame. The upper ends of rods 541 are fixed with support frame 540.

Figure 28:
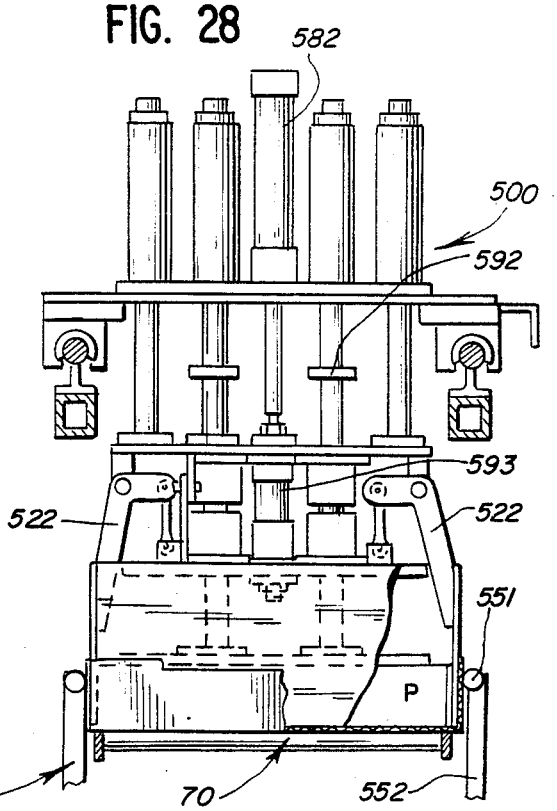
FIG. 28 is a view similar to FIG. 27 with package forming assembly in the package forming station, with the carton flap forming rollers elevated in juxtaposition with the carton flap mandrels to form the package sides and ends.

Frame 540 journals four main flap rollers 548, 550. Each is journalled on brackets 551 fixed to the support frame 540. When cylinder 553 extends rod 554, the flap rollers 548, 550 move upwardly, as shown by FIG. 28. The rollers engage the bottoms of peripheral portions of the carton blank, crease them against the lower edge portions of the mandrel flaps 531 and 532, and move and fold those carton portions upwardly to form carton side portions and carton end portions integral with the carton blank base portion. In those vertical positions, as shown by FIG. 28, the carton side and end portions are disposed between the framing flaps 531, 532 and rollers 548, 550, respectively.

That leaves the edge flap portions (shown in FIG. 2 as EF) to be folded 90° from their associated end portions into engagement with the carton side portions to permit the interposed adhesive initially deposited on edge flap portions EF to unify the carton and complete the package P. Four corner rollers 563 are provided for that purpose. They are rotatably journalled on journals 562 fixed to pillow blocks 561. Pillow blocks 561 are slidable along guide rails 560 which are suitably clamped to and fixed with frame 540.

Figure 24:
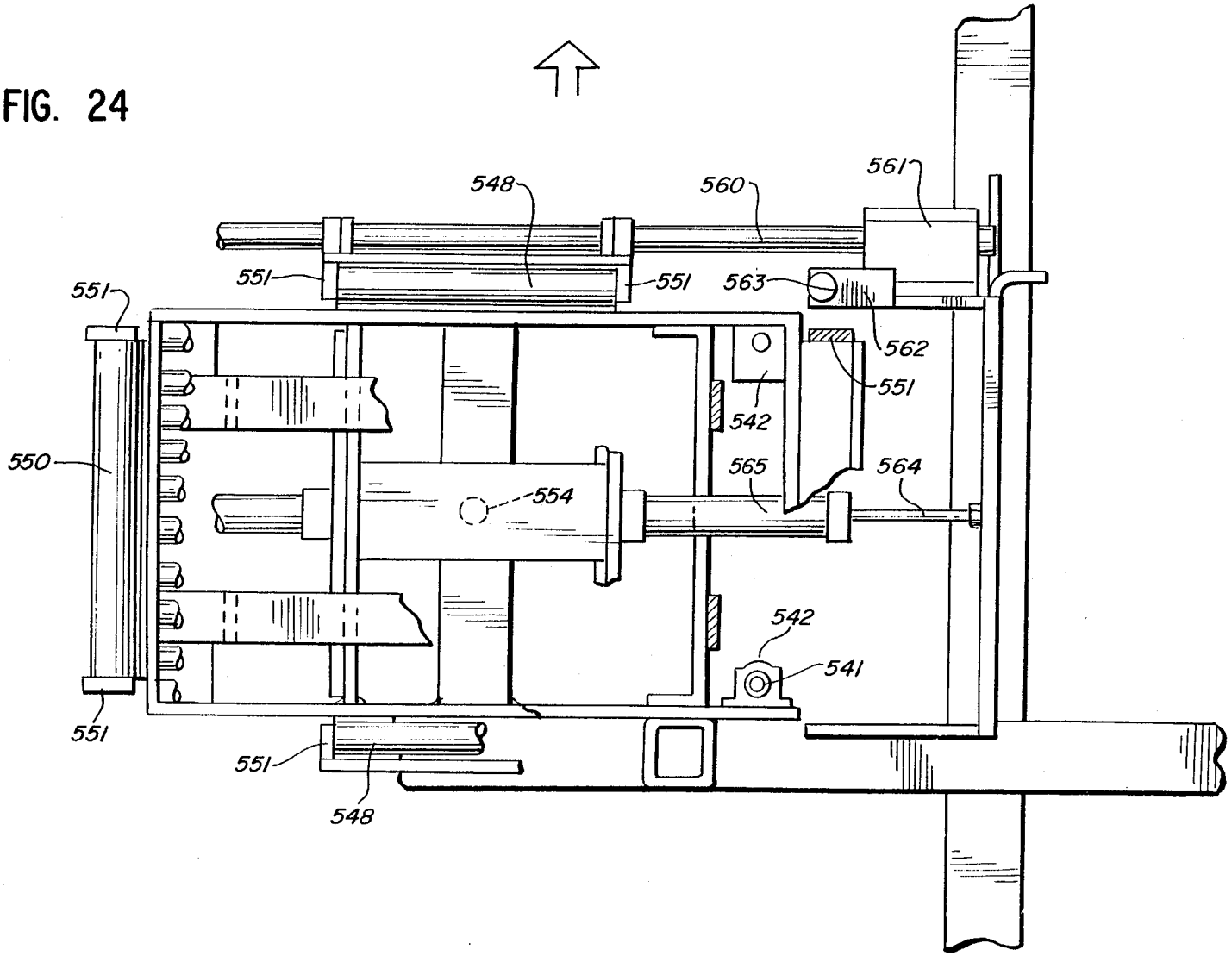
FIG. 24 is a partial plan view, viewed from line 24—24 of FIG. 22.

When the corner rollers 563 are to be moved to contact edge flaps EF and to fold them to the position of FIG. 2, two cylinders 565 are activated causing their piston rods 564 to be drawn inwardly from the position of FIG. 24. Cylinders 565 are fixed to frame 540. At their free ends, rods 564 are fixed to the pillow blocks 561, and therefore draw the pillow blocks and associated corner rollers 563 inwardly (as seen in FIG. 24) causing the corner rollers to fold the edge flaps EF to the positions of FIG. 2. They are held there for a time sufficient to insure adherence of the edge flap portions EF, and are then retracted to their inactive position.

Thereafter the lower roller assembly is retracted to the position of FIG. 21 and the carton framing mandrel flaps 531, 532 are retracted and elevated to the position of FIG. 21 by retracting piston rod 594 and partially retracting piston rod 583 while the fruit hold-down plate 529 remains in contact with the completed package P. When the stops 592 engage control plate 524, the fruit hold-down plate 529 is elevated conjointly with the control plate 524 until the upper head portion 500 reaches the elevation illustrated in FIG. 25.

Operation and Sequencing of the Package Forming Machine

Figure 29:
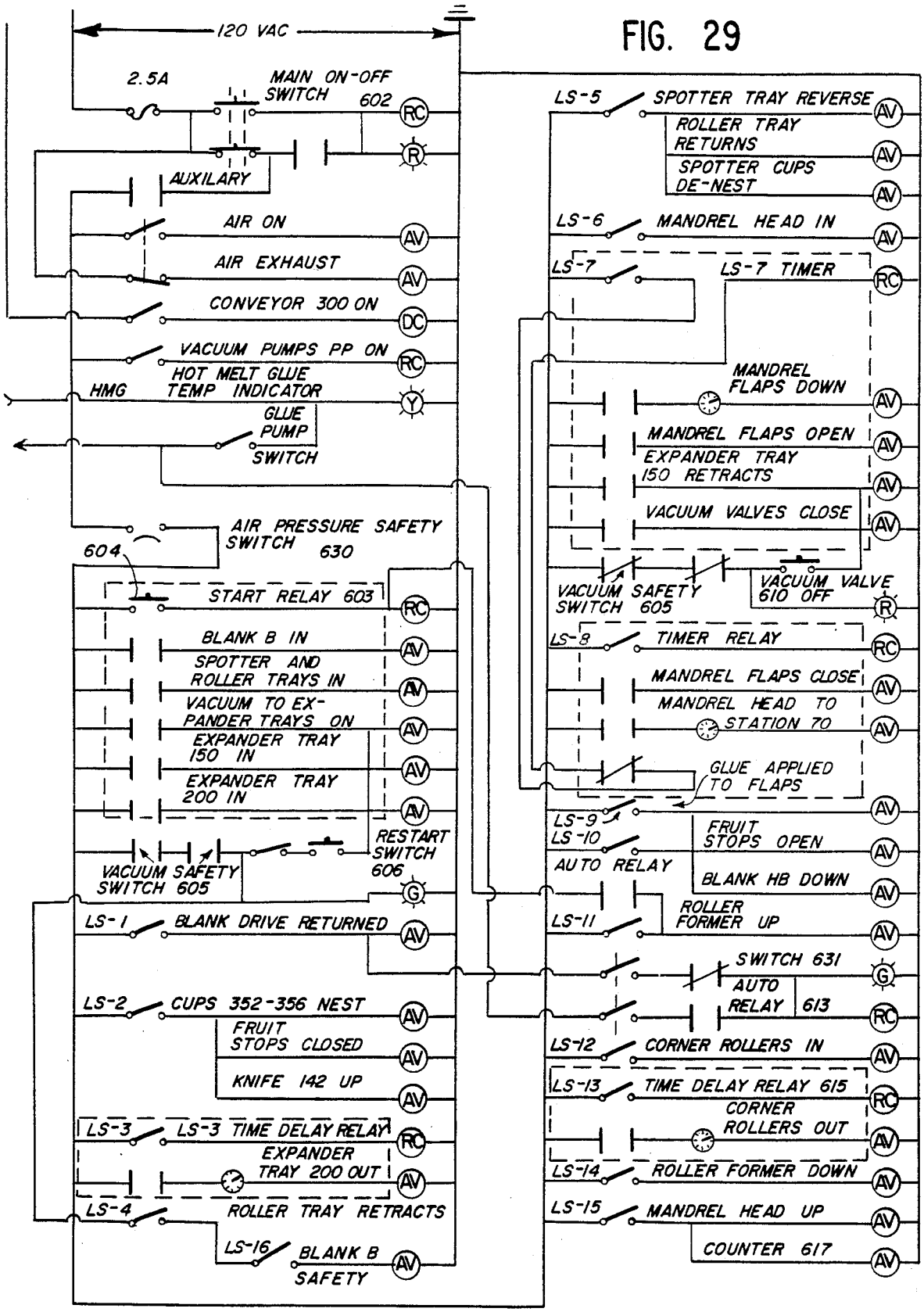
FIG. 29 is a schematic sequencing and circuit diagram of the assembly of FIG. 1.

The operation and sequencing of the package forming machine 1 will now be described with reference especially to FIG. 29.

The machine 1 is first activated by a suitable main on-off switch 602 provided at control box 600. A red light "R" at the control box 600 indicates the system is on. This activates the air supply through an air valve (AV, FIG. 29) for the several cylinders, the air exhaust for the cylinders is closed, the direct current (DC) operated driven conveyor 300, the vacuum pumps PP and the heater for the hot melt glue supply HMG, the temperature of which is controlled by a suitable thermostat. If the glue is not up to temperature, as shown by yellow light "Y" (FIG. 29), the start relay 603 will not activate. A suitable glue pump GP (FIG. 3) is provided to pump glue to the glue dispensing heads 596. A conventional air pressure safety switch 630 shuts down the system if the air pressure drops below 80 psig.

When all of those are ready, as shown by suitable indicators at control box 600, a start relay 603 (through a relay coil RC, FIG. 29) automatically actuates a start switch 604 or the system is initiated manually the first time via a push button for actuating start switch 604.

Upon actuation of switch 604, the blank cylinder 130 is actuated, drawing a carton blank B from the stack at station 10 into station 20. When the blank cylinder reaches a position in which the blank B is properly located, a contactor LSC-1 engages limit switch LS-1 causing the cylinder 130 to retract. In many cases, the limit switch contactor (LSC) for the corresponding limit switch (LS) is shown in the drawings. In each case, in the following description, the member carrying the particular contactor is identified.

During a previous cycle a honeycomb blank HB will have been moved downwardly by guillotine knife 142 and cylinder assemblies 144 to locate blank HB on support feet 151 of expander tray 150. The inclined, driven conveyor 300, which runs continuously, will have fed fruit deposited thereon forwardly into chute 306, thereby providing the chute 306 with a load of fruit to be deposited in the spotter tray. The stop plate 318 will be positioned as shown in FIG. 12 and the arms 314 will be in the position shown in FIG. 12 to hold back the fruit on the inclined conveyor 300.

Continuing, in response to actuation of switch 604, the spotter tray 350 and roller tray 380 are moved into station 20 by spotter tray cylinder 408. Cylinder 324 retracts the fruit stop plate 318 and arms 314 permitting the fruit to move downwardly in chute 306 to fall into spotter cups 352-356 and to rest on the rollers in roller tray 380. When the spotter tray reaches its forwardmost position, it contacts limit switch LS-2 via a spotter tray portion LSC-2 (FIGS. 5, 16). Switch LS-2 causes the guillotine knife cylinder to raise the knife 142 and to activate stop cylinder 324 to cause it to return stop 318 to the closed position of FIG. 12 and also to allow fruit to again to fill the vertical portion of the chute 306. Switch LS-2 also causes cups 352-356 to nest, i.e., to move from the fruit receiving position of FIG. 14 to the nested fruit depositing position of FIG. 15.

Vacuum valve 610 is then actuated, communicating the suction cups of the expander trays with the vacuum source provided by pumps PP. The expander trays 150, 200 are then moved inwardly via their cylinders 170, 450, 458 until they reach their full in positions in which they grip opposite sides of a honeycomb blank HB.

Figure 17:
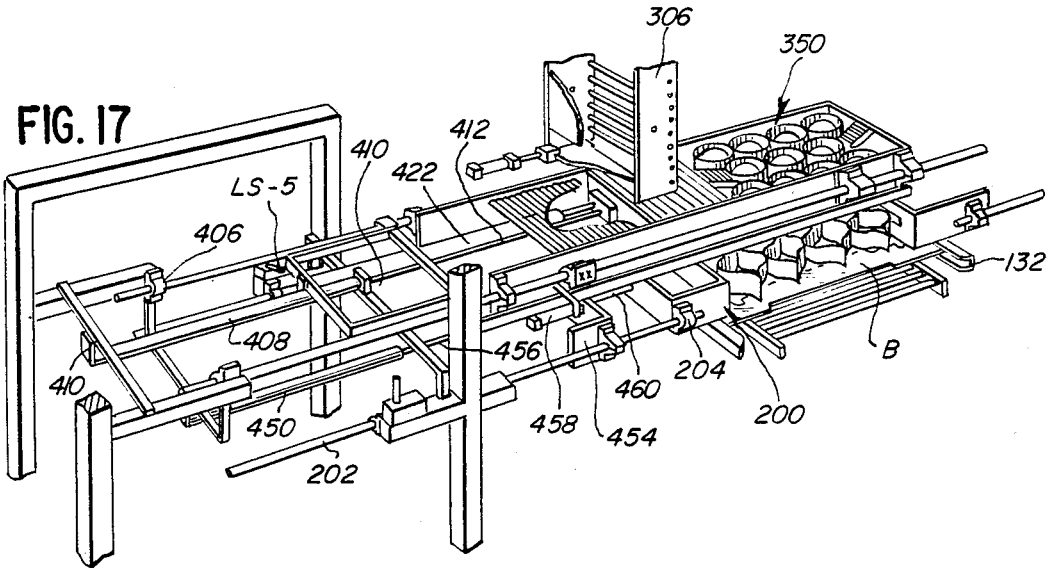
FIG. 17 is a view like FIG. 16 with the honeycomb blank expanded and spotter cups in the position of FIG. 14.

When expander tray 200 reaches the position of FIG. 16 it engages a limit switch LS-3. Switch LS-3 is held closed and operates a timing relay which may be set, as for two or three seconds. If there is sufficient system vacuum on the suction cups, the expander tray 200, when it retracts at the conclusion of the two or three second delay, will expand the honeycomb blank HB, as shown in FIG. 17. A green light "G" at the control box will indicate that a cycle is ready to proceed. If the vacuum is insufficient, or if honeycomb blank HB broke loose (or if there is no blank HB present), upon the return of the expander tray a vacuum safety switch 605 (see FIG. 29) will stop the machine 1. The machine may then be restarted by a restart switch 606 which will cause the expander tray 200 to again move into station 20, to engage limit switch LS-3 and again to go through the cycle described.

Figure 18:
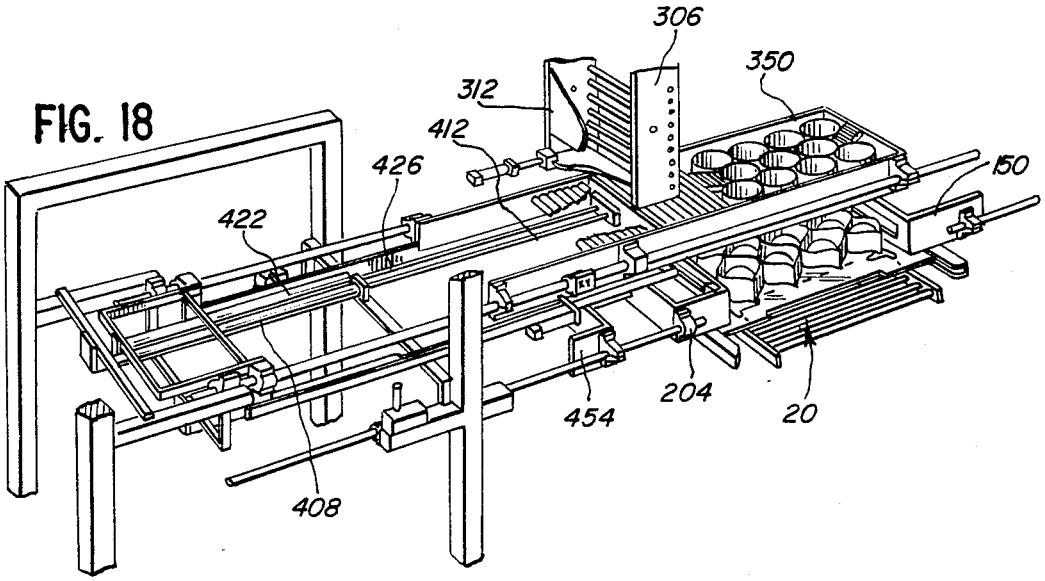
FIG. 18 is a view like FIG. 17 with the spotter cups in the nested position of FIG. 15 and with the roller tray retracted.
Figure 19:
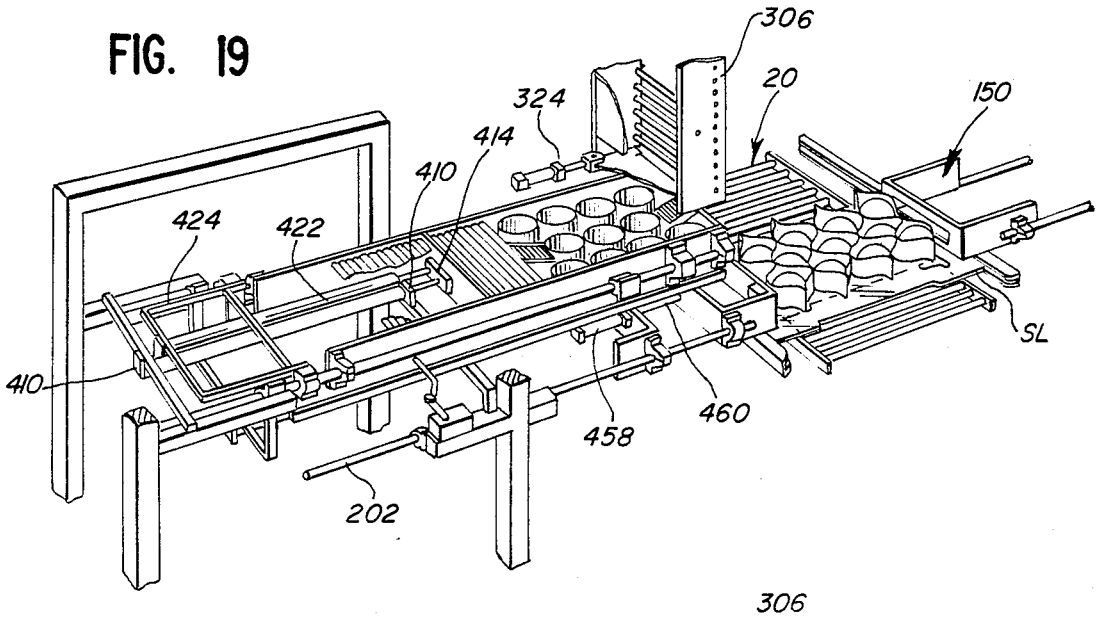
FIG. 19 is a view like FIG. 18 with the fruit spotter tray retracted.

If there is sufficient vacuum on the system the honeycomb blank will open. When expander tray 200 reaches the position of FIG. 17, it will contact limit switch LS-4 which activates roller tray cylinder 422 retracting it from beneath the spotter tray. A limit switch LS-16 (see FIG. 9) is provided near the end of the movement of the carton blank B so that if the carton blank does not move to the fruit receiving position, the roller tray will not be retracted. As the roller tray retracts, it withdraws its support for the fruit and the fruit drops into the honeycomb cells as shown in FIG. 18. The retracting roller tray contacts limit switch LS-5 which activates tray cylinder 408 to retract the spotter tray and the roller tray cylinder to retract the roller tray, to the positions of FIG. 19, and which causes the spotter cups to denest.

The spotter tray, on its full retraction, contacts a limit switch LS-6 to activate the mandrel head cylinder 514 causing head 500 to travel along the rails 510 into the loading station 20, i.e., to the position illustrated in FIG. 25. When the head portion 500 reaches that position it contacts limit switch LS-7 which activates a timer. The timer sequentially activates cylinders 582 and 593 to move the mandrel flaps 531, 532 and fruit hold-down plate 529 downwardly and into their open positions.

When the flaps reach their open positions, the expander tray 150 retracts and the vacuum valves 610 are closed, allowing the expanded honeycomb to embrace the fruit. A limit switch LS-8, activated by the mandrel reaching its full down position, activates a timing relay and causes cylinder 593 to close the flaps 531, 532 to the honeycomb fruit-embracing position of FIG. 27. Switch LS-8 further activates cylinder 514 to cause the head and fruit assembly to move towards the package forming station 70. As that movement takes place, puller fingers 595 on head portion 500 engage the trailing edge of the carton blank B, causing it to move conjointly with the honeycomb-fruit assembly HCF.

As the head portion 500 moves towards station 70, cams LSC-9 on the head 500 engage limit switch LS-9 which activate glue pump valves GP, causing glue to be deposited on the inner surfaces of the front and rear edge flaps EF of carton blank B. Cams LSC-9 also engage switch LS-10 which opens the fruit stop and which moves a blank HB down by knife 142.

When the head portion 500 reaches the package forming station 70 position exemplified by FIG. 28, limit switch LS-11 is contacted. This does two things. For one, it energizes the auto relay 613 (FIG. 29) which in turn energizes the start relay 603, causing a new cycle to be initiated for loading station 20. If, however, the glue is not up to temperature, the switch 631 (FIG. 29) will not close, and the cycle will stop. Assuming the switch 631 is closed, the limit switch LS-11 continues the package forming cycle which is already under way and to that end activates cylinder 553 which elevates the lower roller forming assembly 502, folding the four carton flaps of the package against the mandrel flaps 531, 532. When the rollers 548, 550 reach the upper position of FIG. 28, a further limit switch LS-12 is engaged, activating corner roller cylinders 565. The corner rollers 563 then fold the edge flaps EF inwardly forcing the interposed glue into contact with the carton side flaps. When the corner rollers 563 reach their innermost positions they contact a limit switch LS-13 which operates a time delay relay 615 (FIG. 29), holding the rollers in that position for a predetermined time period, as from about 1 to 10 seconds, adequate to set and dry the glue. Thereafter the roller cylinders 565 are automatically activated to withdraw the corner rollers which, on their return to their inactive position, contact a limit switch LS-14.

Limit switch LS-14 activates cylinder 553 causing the roller former to withdraw to the position of FIG. 22 at which a further limit switch LS-15 is engaged, activating mandrel head cylinder 582 to raise head 500 to the position of FIG. 25. As the mandrel head 500 elevates, the fruit stop plate remains in engagement with the fruit until the flaps 531, 532 are withdrawn from the package.

When the head 500 reaches the position of FIG. 25, it activates a suitable counter 617.

Finally, the next previous package P is adapted to be pushed out of station 70, along discharge rollers 620, by pusher arms 598 at the forward end of head 500 as the head moves from the loading station 20 into the package forming station 70.

As will be seen, the package P has a series of stacking lugs SL formed integrally with the side and end portions of the carton blank, thereby to permit stacking of a series of such packages without damaging or compressing the contained articles or fruit. The packages may be stacked individually or, if desired, may be stacked within a further carton to contain 2, 3, 4 or more rows.

Although but one embodiment has been described, it will be apparent to those skilled in the art that modifications may be made. Accordingly, it is intended that the invention shall not be construed as being limited except insofar as may be made necessary by the appended claims.

What is claimed is:

1. A machine for automatically forming a completed carton containing articles of varying sizes such as fruit in cells of protective expanded honeycomb comprising:
   - a work station having first, second and third input sections, an output section and means to receive and position a carton blank,
   - means for holding a stack of carton blanks and feeding them one at a time to said work station via said first input section,
   - means for holding a stack of honeycomb blanks and feeding them one at a time to said work station via said second input section,
   - means for feeding articles to be cartoned to said work station via said third input section,
   - means for expanding a honeycomb blank into expanded cell-containing honeycomb at said work station directly above a carton blank positioned in said work station,
   - means for depositing individual said articles in cells of said expanded honeycomb resting on the top surface of said carton blank to provide an article filled expanded honeycomb (AFEH) on said carton blank,
   - means for providing a multilateral mandrel defining substantially the entire periphery of said carton,
   - means to move said mandrel first into and later out of position directly above said carton blank and surrounding said AFEH,
   - means for folding said carton blank about said mandrel into a base portion supporting said AFEH and into side portions and end portions that will closely embrace the sides and ends of said AFEH to create said completed carton, and
   - means to remove said completed carton from said machine via said output section.

2. The machine of claim 1 wherein said means for folding is part of said output section and said output section includes means to apply glue to portions of said carton blank while it travels in said output section.

3. A machine for automatically forming a completed carton containing articles of varying sizes such as fruit in cells of protective expanded honeycomb comprising:

a work station having first, second and third input sections, an output section and means to receive and position a carton blank, said output section including a package forming position and glue application means upstream of said position, means for holding a stack of carton blanks and feeding them one at a time to said work station via said first input section, means for holding a stack of honeycomb blanks and feeding them one at a time to said work station via said second input section, means for feeding articles to be cartoned to said work station via said third input section including:

a downwardly inclined conveyor and a downwardly opening chute for receiving articles from said conveyor, means for expanding a honeycomb blank into expanded honeycomb containing rows of cells at said work station directly above a carton blank positioned in said work station, means for depositing individual articles at said work station in said cells of said expanded honeycomb resting on the top surface of said carton blank to provide an article filled expanded honeycomb (AFEH) on said carton blank including:

spotter means for receiving said articles from said chute and locating them in rows corresponding to said rows of said cells plus means for traversing said cells with said spotter means sequentially to fill said rows of cells with said articles, means for providing at said work station a multilateral mandrel defining substantially the entire periphery of said carton, means to move said mandrel first into and later out of position directly above said carton blank and surrounding said AFEH, means at said package forming position for folding said carton blank about said mandrel into a base portion supporting said AFEH and into side portions and end portions that will closely embrace the sides and ends of said AFEH to create said completed carton, and means to remove said completed carton from said machine via said output section.

4. A method for automatically forming a completed carton containing articles of varying sizes such as fruit in cells of protective expanded honeycomb comprising:

feeding to and positioning a carton blank in a work station, feeding a honeycomb blank to said work station, expanding said honeycomb blank into expanded cell-containing honeycomb at said work station directly above said carton blank positioned in said work station, feeding a mutiplicity of said articles to be cartoned to said work station and individually depositing them in separate cells of said expanded honeycomb resting on the top surface of said carton blank to provide an article filled expanded honeycomb (AFEH) on said carton blank, providing a multilateral mandrel defining substantially the entire periphery of said carton, positioning said mandrel directly above said carton blank and surrounding said AFEH, moving said mandrel surrounded AFEH from said work station to a package forming position, applying glue to partions of said carton blank during said moving, folding said carton blank at said position with the aid of said mandrel into a base portion supporting said AFEH plus side and end portions to closely embrace the sides and ends of said AFEH by bending said portions about the lower end of said mandrel and into contact with the mandrel sides to create said completed carton, withdrawing said mandrel from said completed carton at said position, and removing said completed carton from said machine.

5. The method of claim 4 wherein said positioning step includes:

providing an article spotter tray containing individual spotter cups, providing a support tray beneath said spotter tray, disposing separate articles into said spotter cups, and withdrawing said support tray from beneath said spotter tray to permit said articles to drop from said cups into said cells.

* * * * *